US006811619B2

(12) United States Patent
Hayakawa et al.

(10) Patent No.: US 6,811,619 B2
(45) Date of Patent: Nov. 2, 2004

(54) METHOD OF MANUFACTURING GRAIN-ORIENTED ELECTRICAL STEEL SHEETS

(75) Inventors: Yasuyuki Hayakawa, Kurashiki (JP); Hideo Yamagami, Kurashiki (JP); Seiji Okabe, Kurashiki (JP); Takeshi Imamura, Kurashiki (JP); Minoru Takashima, Kurashiki (JP); Mitsumasa Kurosawa, Kurashiki (JP)

(73) Assignee: JFE Steel Corporation (JP)

( * ) Notice: Subject to any disclaimer, the term of this patent is extended or adjusted under 35 U.S.C. 154(b) by 267 days.

(21) Appl. No.: 10/202,117

(22) Filed: Jul. 23, 2002

(65) Prior Publication Data

US 2003/0116236 A1 Jun. 26, 2003

(30) Foreign Application Priority Data

Jul. 24, 2001 (JP) ..... 2001-222626
Jan. 9, 2002 (JP) ..... 2002-001917
Jan. 9, 2002 (JP) ..... 2002-001911

(51) Int. Cl.[7] ..... H01F 1/16
(52) U.S. Cl. ..... 148/111; 148/13
(58) Field of Search ..... 148/110–113

(56) References Cited

U.S. PATENT DOCUMENTS 5,205,872 A * 4/1993 Mitsunori et al. ..... 148/111
5,308,411 A * 5/1994 Suga et al. ..... 148/113
6,444,050 B1 * 9/2002 Komatsubara et al. ..... 148/111
6,444,051 B2 * 9/2002 Komatsubara et al. ..... 148/111
6,451,128 B1 * 9/2002 Lee et al. ..... 148/111

FOREIGN PATENT DOCUMENTS

JP 2-30714 * 2/1990 ..... 148/111

* cited by examiner

*Primary Examiner*—John P. Sheehan
(74) *Attorney, Agent, or Firm*—Piper Rudnick LLP

(57) ABSTRACT

A method of manufacturing a grain-oriented steel sheet including hot-rolling a slab prepared using molten steel containing, by mass %, C of not more than about 0.08%, Si of about 2.0 to about 8.0% and Mn of about 0.005 to about 3.0%; optionally annealing the hot-rolled steel sheet; performing cold rolling once, or twice or more with intermediate annealing therebetween; performing primary recrystallization annealing in a low- or non-oxidizative atmosphere and adjusting the C content in the steel sheet after primary recrystallization annealing to be held in the range of about 0.005 to about 0.025 mass %; performing secondary recrystallization annealing; decarburization annealing; and, preferably, performing additional high-temperature continuous or batch annealing. A grain-oriented electrical steel sheet having a sufficiently high magnetic flux density and a low iron loss can be advantageously obtained even when it is manufactured without using an inhibitor.

31 Claims, 7 Drawing Sheets

METHOD OF MANUFACTURING GRAIN-ORIENTED ELECTRICAL STEEL SHEETS

BACKGROUND

1. Field of the Invention

This invention relates to a method of manufacturing a grain-oriented electrical steel sheet, which is primarily used as an iron core material for large-sized motors, generators and transformers, which does not have an undercoating made of primarily forsterite ($Mg_2SiO_4$) (glass coating), and has a high magnetic flux density and preferably has a low iron loss.

2. Description of the Related Art

Grain-oriented electrical steel sheets having a low iron loss are used as iron core material for large-sized motors, generators and transformers because energy loss attributable to iron loss is considered as an important factor in such equipment.

FIG. 1 shows, by way of example, the shape of punched pieces of a grain-oriented electric steel sheet, which are laminated to form an iron core (stator) of a large-sized generator. As shown in FIG. 1, a number of fan-shaped segments 2 are punched from a grain-oriented electrical steel sheet 1 supplied in the form of a strip, and the iron core is assembled by laminating the segments 2 one above another.

When employing such a laminating method, each segment is punched into a complicated shape including teeth 3.

Also, dies are employed to punch several tons or more of iron core material, and a very large number of times of punching is required. Therefore, a grain-oriented electrical steel sheet causing less wear of the dies when punched successively, namely, having good punching quality, is demanded.

Surfaces of a grain-oriented electrical steel sheet are usually coated with an undercoating made of primarily forsterite ($Mg_2SiO_4$) (glass coating). Undercoating made of primarily forsterite strongly adheres with the coating thereon (usually comprising phosphate and colloidal $SiO_2$), so that said coating thereon can apply tension to the steel sheet. Because the tension applied to steel sheet reduces the iron loss of the steel, undercoating made of primarily forsterite is substantially necessary to ensure excellent magnetic characteristics. However, because the forsterite coating is much harder than a coating of an organic resin that is coated on a non-oriented electrical steel sheet, wear of the punching dies is increased. Accordingly, re-polishing or replacement of the dies is required at higher frequency, which reduces the work efficiency and increases the cost when iron cores are manufactured by iron-consuming makers. Further, slitting and cutting quality are similarly deteriorated by the presence of the forsterite coating.

As a method of improving punching quality of a grain-oriented electrical steel sheet, it is conceivable to remove the forsterite coating by pickling or a mechanical manner. However, this method not only increases the cost, but also raises a serious problem that the surface of the steel sheet is marred and magnetic characteristics are deteriorated.

Japanese Examined Patent Application Publication Nos. 6-49948 and 6-49949 propose a technique for inhibiting formation of the forsterite coating by mixing an inhibitor in an annealing separator that is made of primarily MgO and is applied in a final finishing annealing step. Additionally, Japanese Unexamined Patent Application Publication No. 8-134542 proposes a technique for applying an annealing separator, which is made primarily of silica and alumina, to a starting material containing Mn.

With those proposed techniques, however, it is very difficult to obtain a product sheet in which generation of forsterite is completely inhibited, because forsterite is partly formed in many cases with local variations in the final finishing annealing atmosphere caused between coil layers.

In view of that situation, we previously proposed, in Japanese Unexamined Patent Application Publication No. 2000-129356, a technique for developing secondary recrystallization in a high-purity material, which contains no inhibitor component, by utilizing the grain boundary migration suppressing effect of solid solution nitrogen. Also, we previously proposed, in Japanese Unexamined Patent Application Publication No. 2001-32021, a technique for suppressing generation of an oxide coating by using a composition containing a reduced amount of C and by low-oxidation atmosphere for recrystallization annealing has less oxidizing power.

Those techniques succeeded in manufacturing a grain-oriented electrical steel sheet in which forsterite is not formed at a relatively inexpensive cost. The thus-manufactured grain-oriented electrical steel sheet is suitably used for large-sized motors and generators in which punching quality is important, because the steel sheet has no hard forsterite coatings on its surfaces.

However, when manufacturing a grain-oriented electrical steel sheet without using an inhibitor, there still remains the problem that the manufactured steel sheet has a lower magnetic flux density than the case of manufacturing it using an inhibitor.

SUMMARY OF THE INVENTION

With the view of effectively overcoming the problem set forth above, it would be advantageous to provide a novel manufacturing method which can advantageously manufacture a grain-oriented electrical steel sheet having a sufficiently high magnetic flux density and preferably having a low iron loss, even when no inhibitor is used in the manufacturing process.

It is to be noted that this invention is also applicable to the case of manufacturing a grain-oriented electrical steel sheet using an inhibitor and can advantageously manufacture a grain-oriented electrical steel sheet having a sufficiently high magnetic flux density and a low iron loss.

As a result of conducting intensive studies to achieve the above object, we discovered that, when manufacturing a grain-oriented electrical steel sheet not having a forsterite coating by using a starting material which contains no inhibitor component, the magnetic flux density is remarkably improved by performing final finishing annealing (secondary recrystallization annealing) in the state where a certain amount of C remains, and that magnetic characteristics are further remarkably improved by additionally performing high-temperature continuous or batch annealing in a non-oxidizative or low-oxidizative atmosphere after decarburization annealing. Further, we discovered that the secondary recrystallization annealing is able to serve also as decarburization annealing by introducing a hydrogen atmosphere during the second-half period of the annealing process at high temperature.

Thus, selected features of the present invention are as follows:

The invention resides in a method of manufacturing a grain-oriented electrical steel sheet not having an undercoating made of primarily forsterite ($Mg_2SiO_4$) and having a high magnetic flux density, the method comprising the steps of preparing a slab using molten steel containing, by mass %, C of not more than about 0.08%, Si of about 1.0 to about 8.0% and Mn of about 0.005 to about 3.0%, in which the contents of Al and N are preferably reduced to be not more than about 150 mass ppm and about 50 mass ppm, respectively; rolling the slab to obtain a steel sheet; performing primary recrystallization annealing (so-called "recrystallization annealing") on the rolled steel sheet in an atmosphere with the dew point of preferably not higher than about 40° C. and adjusting the C content in the steel sheet after the primary recrystallization annealing to be held in the range of about 0.005 to about 0.025 mass %; performing secondary recrystallization annealing (so-called "final finishing annealing", usually batch annealing) in an atmosphere with the dew point of preferably not higher than about 0° C.; and then performing decarburization annealing.

In the above-described method, preferably, the rolling step comprises steps of hot-rolling the slab; annealing a hot-rolled sheet as required; and performing cold rolling once, or twice or more with intermediate annealing therebetween.

In the above-described method, the secondary recrystallization annealing is preferably performed without applying an annealing separator, but the secondary recrystallization annealing may be performed after applying an annealing separator that does not form forsterite (i.e., does not contain MgO).

In the above-described method, preferably, the secondary recrystallization annealing is performed in a nitrogen-containing atmosphere.

Also, for obtaining a grain-oriented electrical steel sheet having a high magnetic flux density and a low iron loss, molten steel containing Al in amount reduced to be not more than about 100 mass ppm, and N, S and Se in amounts each reduced to be not more than about 50 mass ppm is used as the aforesaid molten steel.

Further, preferably, the molten steel (or the steel sheet) contains, by mass %, at least one element selected from among Ni: about 0.01 to about 1.50%, Sn: about 0.01 to about 0.50%, Sb: about 0.005 to about 0.50%, Cu: about 0.01 to about 0.50%, P: about 0.005 to about 0.50%, and Cr: about 0.01 to about 1.50%.

The C content in the molten steel is preferably not less than about 0.005 mass %, and preferably not more than about 0.025 mass %.

In the above-described method, the decarburization annealing is preferably performed as continuous annealing in a humid atmosphere. As an alternative, flattening annealing serving also as the decarburization annealing may be performed.

Also, in the process of manufacturing a grain-oriented electrical steel sheet having a high magnetic flux density and a low iron loss, the steel sheet may be decarburized in the second half of the secondary recrystallization annealing instead of performing the decarburization annealing as a separate step. When decarburizing the steel sheet in the second half of the secondary recrystallization annealing, a hydrogen atmosphere with a partial pressure of not lower than about 10 volume % is preferably introduced and the temperature range is preferably not lower than about 900° C. during the secondary recrystallization annealing. In that case, preferably, heat treatment is performed in the temperature range of about 800 to about 900° C. for about 300 minutes or longer before introducing the hydrogen atmosphere.

Moreover, preferably, the C content is reduced to be less than about 50 mass ppm with the decarburization annealing.

Preferably, after performing the decarburization annealing in a humid atmosphere subsequent to the secondary recrystallization annealing, continuous annealing (called "additional continuous annealing") for holding the steel sheet to reside in the temperature range of not lower than about 800° C. for at least about 10 seconds is performed in an atmosphere with the dew point of not higher than about 40° C. With this process, a grain-oriented electrical steel sheet having further improved magnetic characteristics, a higher magnetic flux density and a lower iron loss can be obtained.

Alternatively, preferably, after performing the decarburization annealing in a humid atmosphere subsequent to the secondary recrystallization annealing, batch annealing (called "additional batch annealing") for holding the steel sheet to reside in the temperature range of about 800 to about 1050° C. for at least about 5 hours is performed in an atmosphere with the dew point of not higher than about 40° C. With this process, a grain-oriented electrical steel sheet having further improved magnetic characteristics, a higher magnetic flux density and a lower iron loss can be obtained.

Prior to the additional batch annealing, an annealing separator not forming forsterite (i.e., not containing MgO) may be applied as required.

DESCRIPTION OF SELECTED EMBODIMENTS

Experiments on which the invention is based will be first described below.

[Experiment 1]

A steel slab containing, by mass %, C: 0.055%, Si: 3.2% and Mn: 0.05%, but containing no inhibitor component, in which contents of Al, N and each of other components were reduced to be not more than 25 ppm, 10 ppm and 30 ppm, respectively, was manufactured by continuous casting. After heating the slab to 1120° C., the slab was subjected to hot rolling to obtain a hot-rolled sheet with a thickness of 2.4 mm. The hot-rolled sheet was then annealed in a nitrogen atmosphere under soaking at 900° C. for 20 seconds. Thereafter, the hot-rolled sheet was rapidly cooled and subjected to cold rolling to obtain a cold-rolled sheet with a final thickness of 0.34 mm.

Subsequently, the cold-rolled sheet was subjected to recrystallization annealing (primary recrystallization annealing) under soaking at 900° C. for 30 seconds in an atmosphere that contained 50 volume percent (volume %) of hydrogen and 50 volume % of nitrogen and had the dew point changed to various values, whereby the C content after the primary recrystallization annealing was variously adjusted. Then, final finishing annealing (secondary recrystallization annealing) was performed under conditions that temperature was elevated from the normal temperature to 900° C. at a rate of 50° C./h in a nitrogen atmosphere with the dew point of −20° C., and was held there for 75 hours.

Figure 1:
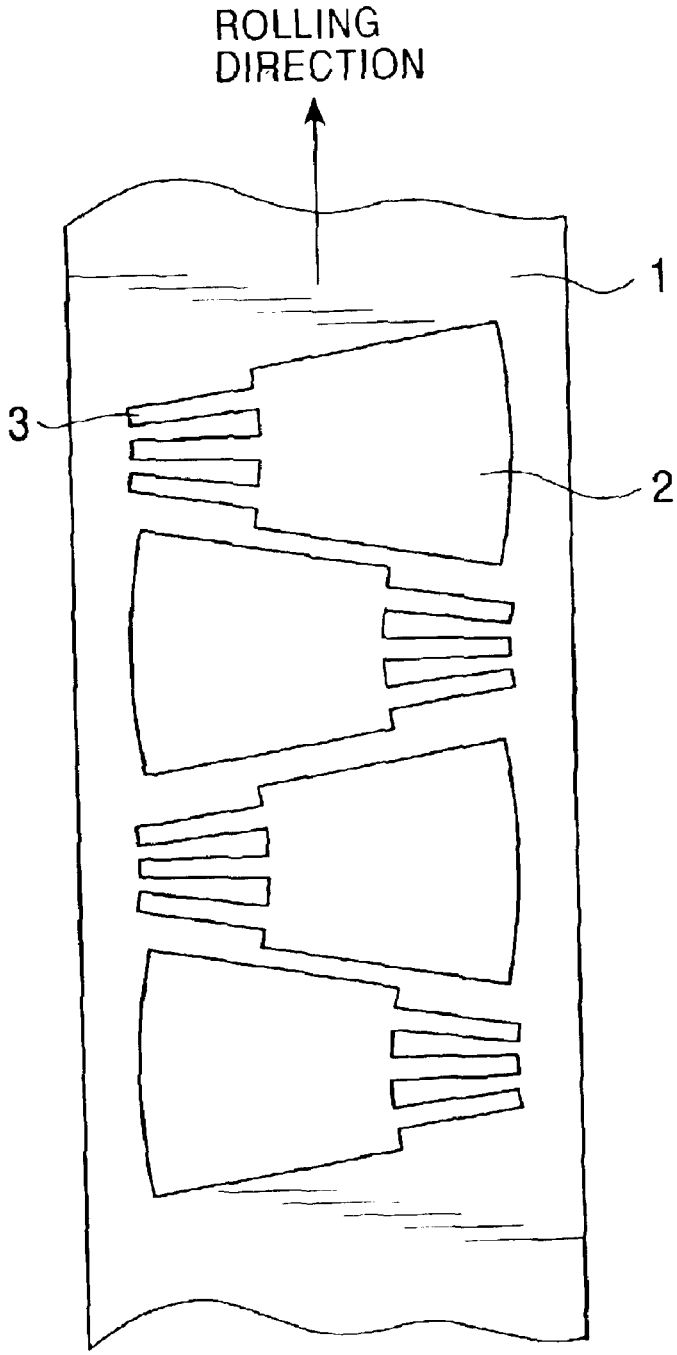
FIG. 1 shows the shape of punched steel sheets used for assembling an iron core (stator) of a large-sized generator.
Figure 2:
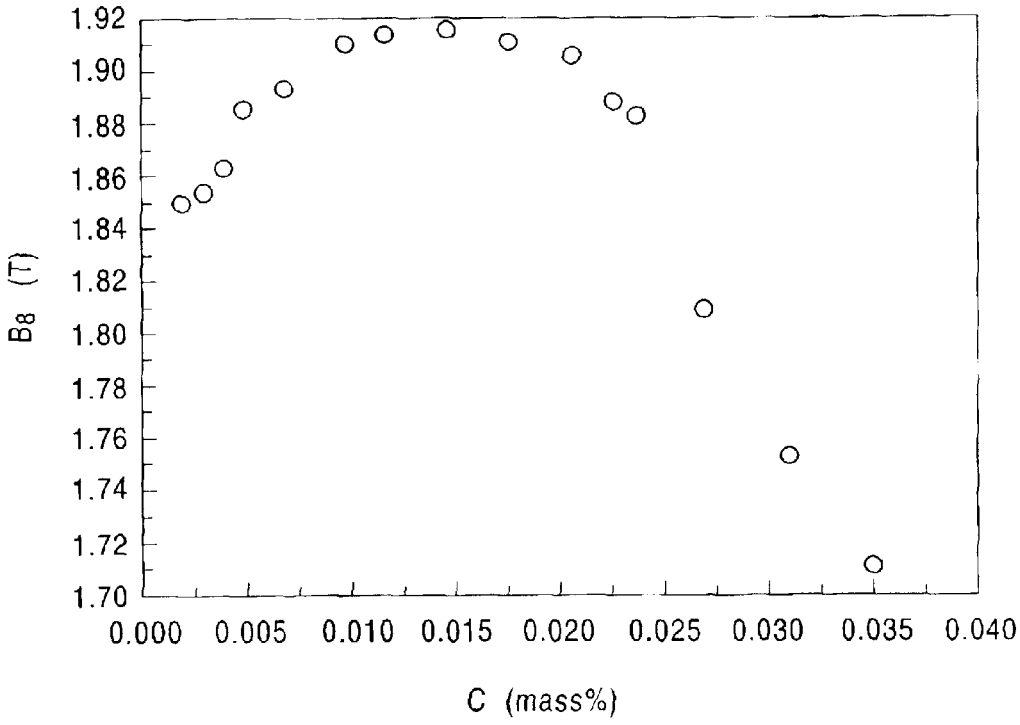
FIG. 2 is a graph showing the relationship between C content after primary recrystallization annealing and magnetic flux density ($B_8$) in the rolling direction of a product sheet.

FIG. 2 shows results of examining the relationship between C content after the primary recrystallization annealing and magnetic flux density ($B_8$) in the rolling direction for a steel sheet obtained after the final finishing annealing. Herein, $B_8$ represents a magnetic flux density at a magnetizing force of 800 A/m.

As seen from FIG. 2, it was confirmed that the magnetic flux density was improved when the secondary recrystallization annealing was performed after the primary recrystallization annealing in the C content range of 0.005 to 0.025%, i.e., in the state where 0.005 to 0.025% of C remained in the steel.

Japanese Unexamined Patent Application Publication No. 58-11738 discloses a technique for use in a method of manufacturing a grain-oriented electrical steel sheet in which a glass coating is formed with finishing annealing by applying an annealing separator made primarily of MgO before finishing annealing. The disclosed technique improves magnetic flux density by performing the finishing annealing with 30 to 200 ppm of C contained in the steel sheet after decarburization annealing.

However, according to the above method of forming a glass coating with the final finishing annealing, C remains after the final finishing annealing because the presence of the glass coating impedes decarburization and it is difficult to effectuate the decarburization after the final finishing annealing. Therefore, the above technique uses the very expensive manufacturing step of, after the final finishing annealing, removing the glass coating formed during the final finishing annealing by pickling and then reducing carbon by performing decarburization annealing again or vacuum annealing.

Also, that method of removing the glass coating by pickling impairs smoothness of the sheet surface and hence inevitably causes deterioration of the iron loss.

Further, the intent of this invention, i.e., improving magnetic characteristics without resorting to an inhibitor and a forsterite coating, is based on the technical concept of ensuring migration speed difference between grain boundaries by increasing purity or further adding a trace amount of solid solution nitrogen, which is also disclosed in the above-cited Japanese Unexamined Patent Application Publication No. 2000-129356. Therefore, it was expected that the method of rendering the steel sheet to contain some amount of C actually deteriorates magnetic characteristics because the presence of C reduces the purity and impedes infiltration of nitrogen during the annealing.

In other words, the results of this experiment are highly surprising and unexpected. The reason why a high magnetic flux density is obtained by performing the secondary recrystallization annealing in the state where C remains in an amount of about 0.005 to about 0.025% is not yet fully understood. We believe, however, that the presence of C in a solid solution state, which is an interstitial element as with N, may increase selectivity of grain boundary migration in the process of secondary recrystallization.

Additionally, since this invention is directed to the method of neither employing an inhibitor nor forming a forsterite coating during the final finishing annealing, decarburization can be easily effectuated during flattening annealing performed after the secondary recrystallization annealing unlike the technique disclosed in the above-cited Japanese Unexamined Patent Application Publication No. 58-11738. Also, since the smooth surface is maintained in the invention, deterioration of iron loss is avoided.

[Experiment 2]

A slab of steel A containing, by mass %, C: 0.015%, Si: 3.2% and Mn: 0.05%, but containing no inhibitor component, in which the contents of Al, N and each of other components were reduced to be not more than 25 ppm, 10 ppm and 30 ppm, respectively, and a slab of steel B containing, by mass %, C: 0.003%, i.e., the C content was greatly reduced with a degassing process, Si: 3.2% and Mn: 0.05%, but containing no inhibitor component, in which contents of Al, N and each of other components were reduced to be not more than 35 ppm, 8 ppm and 30 ppm, respectively, were manufactured by continuous casting.

After heating each slab to 1120° C., the slab was subjected to hot rolling to obtain a hot-rolled sheet with a thickness of 2.4 mm. The hot-rolled sheet was then annealed in a nitrogen atmosphere under soaking at 900° C. for 20 seconds. Thereafter, the hot-rolled sheet was rapidly cooled and subjected to cold rolling to obtain a cold-rolled sheet with a final thickness of 0.34 mm.

Subsequently, the cold-rolled sheet was subjected to recrystallization annealing (primary recrystallization annealing) under soaking at 900° C. for 30 seconds in an atmosphere that contained 50 volume percent (volume %) of hydrogen and 50 volume % of nitrogen and had a dew point of −30° C. Then, final finishing annealing (secondary recrystallization annealing) was performed under conditions that temperature was elevated from the normal temperature to 900° C. at a rate of 50° C./h and was held for 50 hours in a nitrogen atmosphere with a dew point of −20° C., following which the temperature was further elevated to 1000° C. at a rate of 10° C./h after replacing the atmosphere with a hydrogen and nitrogen mixed atmosphere (dew point: −30° C.) having a hydrogen partial pressure changed to various values.

Figure 3:
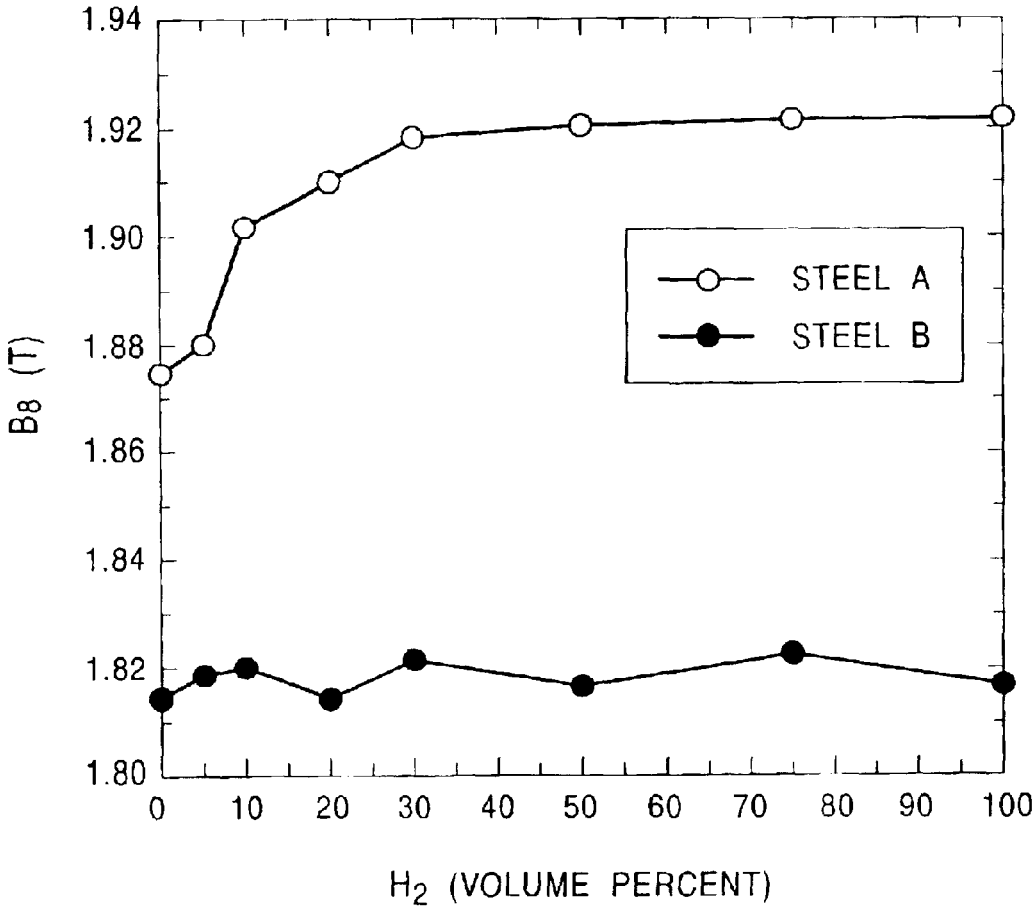
FIG. 3 is a graph showing the relationship between hydrogen partial pressure and magnetic flux density ($B_8$) in a latter stage of secondary recrystallization annealing (final finishing annealing).

FIG. 3 shows the results of examining the relationship between hydrogen partial pressure after replacement of the annealing atmosphere and magnetic flux density ($B_8$) after final finishing annealing.

As seen from FIG. 3, the steel A having a higher C content had a higher magnetic flux density than the steel B having a lower C content.

Also, for the steel A, the magnetic flux density was greatly improved when the hydrogen partial pressure was not lower than 10 volume %, but the effect of improving the magnetic flux density was saturated when the hydrogen partial pressure exceeded 30 volume %.

Figure 4:
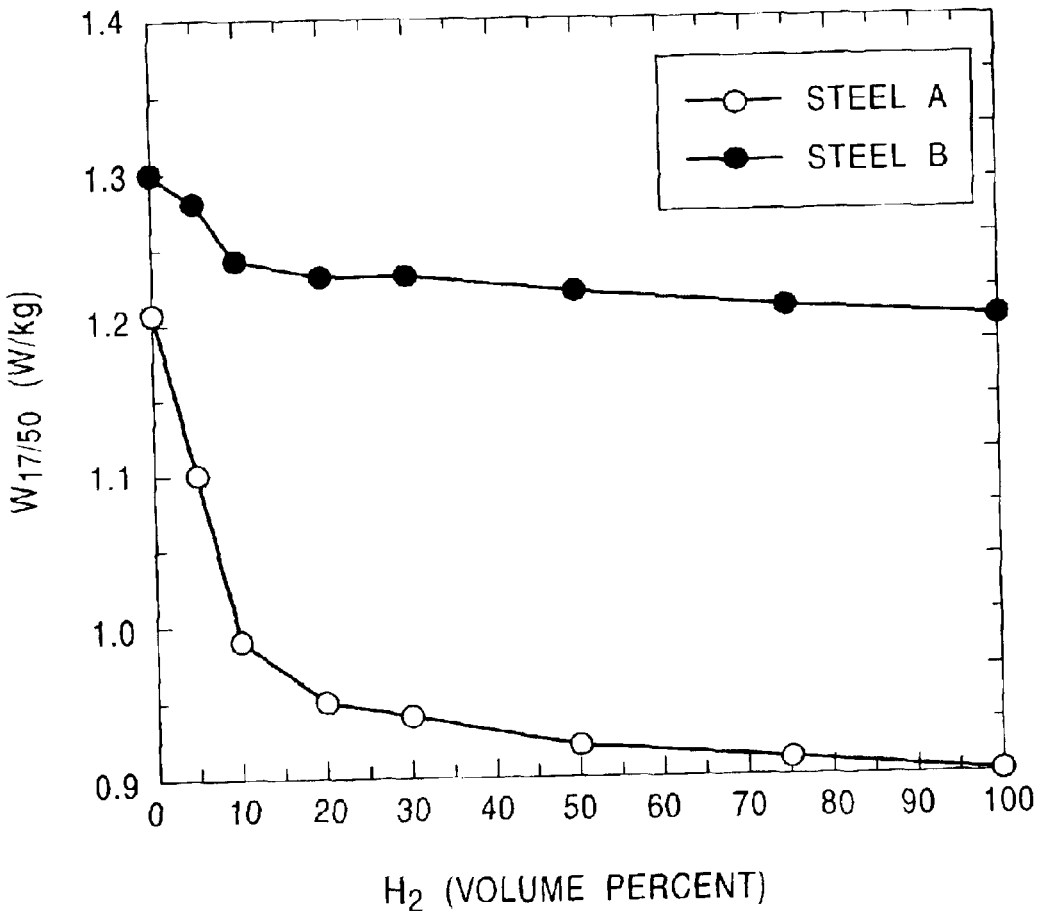
FIG. 4 is a graph showing the relationship between hydrogen partial pressure and iron loss ($W_{17/50}$) in a latter stage of secondary recrystallization annealing (final finishing annealing).

FIG. 4 shows results of examining the relationship between hydrogen partial pressure after replacement of the annealing atmosphere and iron loss ($W_{17/50}$) after final finishing annealing. Herein, $W_{17/50}$ represents a value of iron loss at a frequency of 50 Hz and a maximum magnetic flux density of 1.7T.

As seen from FIG. 4, with an increase of the hydrogen partial pressure, a remarkable improvement in iron loss was confirmed for steel A, but just a slight improvement of iron loss was obtained for steel B.

Figure 5:
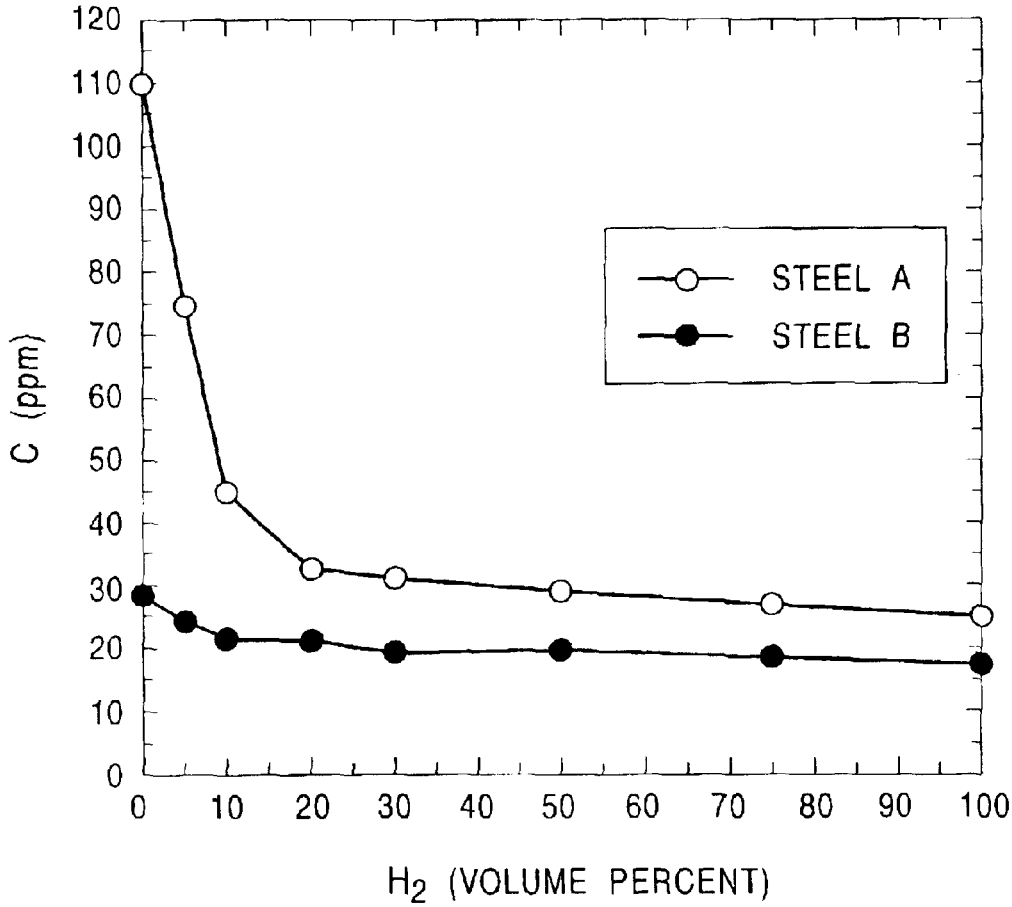
FIG. 5 is a graph showing the relationship between hydrogen partial pressure in a latter stage of secondary recrystallization annealing (final finishing annealing) and C content in the steel after that annealing.

FIG. 5 shows the results of examining the relationship between hydrogen partial pressure after replacement of the annealing atmosphere and C content in the steel after final finishing annealing.

As seen from FIG. 5, when the hydrogen partial pressure exceeds 10%, the C content in the steel can be reduced to be less than 50 ppm even for steel A.

Thus, we believe that introducing a hydrogen atmosphere in the temperature range of not lower than 900° C. effectively encourages decarburization, whereby the magnetic flux density is remarkably increased and iron loss is reduced.

The mechanism of causing the progress of decarburization with a hydrogen atmosphere introduced in the temperature range of not lower than 900° C. is presumably attributable to the fact that carbon is consumed upon generation of hydrocarbons in the surface of the steel sheet. However, we do not yet fully understand all details of the mechanism.

According to the method of this experiment, as described above, magnetic flux density can be obtained by performing the secondary recrystallization annealing in the state where C remains in some amount, and the iron loss can be reduced by then introducing a hydrogen atmosphere at high temperature to encourage decarburization in the final finishing annealing step.

The iron loss is fairly increased when the surface smoothness of the steel sheet is lost by pickling as with the technique as disclosed in the above-cited Japanese Unexamined Patent Application Publication No. 58-11738. Also, even with ordinary decarburization annealing performed in an oxidization atmosphere, the iron loss is slightly increased because an oxide film is formed on the steel sheet surface. In contrast, according to the method of this experiment, since reaction with hydrogen in the secondary recrystallization annealing atmosphere is utilized without forming a forsterite coating, decarburization occurs while maintaining the smooth surface.

[Experiment 3]

A slab of steel A containing, by mass %, C: 0.015%, Si: 3.2% and Mn: 0.05%, but containing no inhibitor component, in which contents of Al, N and each of other components were reduced to be not more than 25 ppm, 10 ppm and 30 ppm, respectively, and a slab of steel B containing, by mass %, C: 0.002%, i.e., the C content greatly reduced with a degassing process, Si: 3.2% and Mn: 0.05%, but containing no inhibitor component, in which the contents of Al, N and each of other components were reduced to be not more than 30 ppm, 15 ppm and 30 ppm, respectively, were manufactured by continuous casting.

After heating each slab to 1100° C., the slab was subjected to hot rolling to obtain a hot-rolled sheet with a thickness of 2.6 mm. The hot-rolled sheet was then annealed in a nitrogen atmosphere under soaking at 900° C. for 30 seconds. Thereafter, the hot-rolled sheet was rapidly cooling and subjected to cold rolling to obtain a cold-rolled sheet with a final thickness of 0.34 mm.

Subsequently, the cold-rolled sheet was subjected to primary recrystallization annealing under soaking at 920° C. for 20 seconds in an atmosphere that contained 30 volume percent (volume %) of hydrogen and 70 volume % of nitrogen and had a dew point of −20° C. Secondary recrystallization annealing was then performed without applying an annealing separator. The secondary recrystallization annealing was performed under conditions that temperature was elevated from ambient temperature to 900° C. at a rate of 50° C./h in a nitrogen atmosphere with a dew point of −20° C., and was held there for 75 hours. Subsequently, decarburization annealing was performed at 850° C. for 60 seconds in an atmosphere that contained 30 volume % of hydrogen and 70 volume % of nitrogen and had a dew point of 40° C.

Thereafter, additional continuous annealing was performed under soaking at various temperatures for 20 seconds in an atmosphere that contained 30 volume % of hydrogen and 70 volume % of nitrogen and had a dew point of −20° C.

Figure 6A:
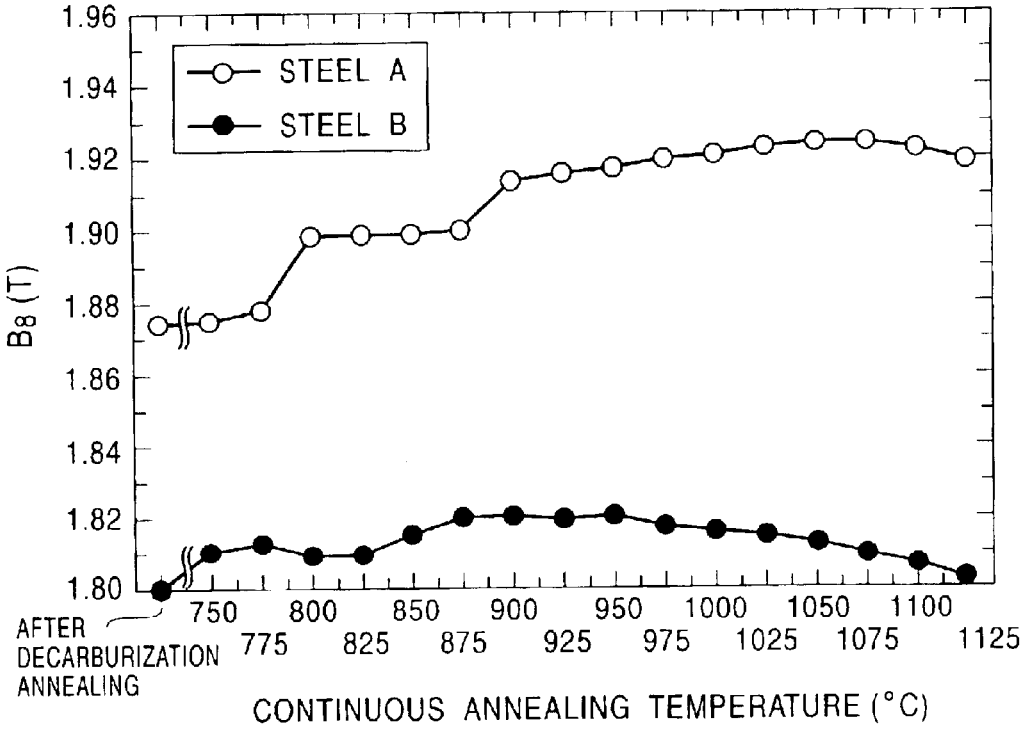
FIG. 6A is a graph showing changes of magnetic flux density ($B_8$) before and after additional continuous annealing.
Figure 6B:
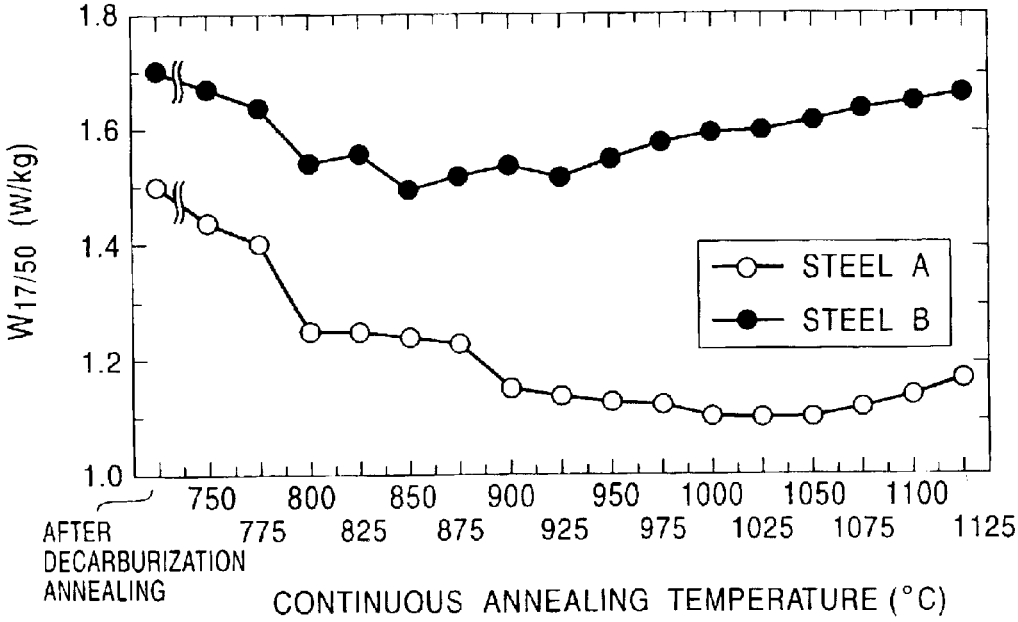
FIG. 6B is a graph showing changes of iron loss ($W_{17/50}$) before and after additional continuous annealing.

FIGS. 6A and 6B show changes in magnetic characteristics before and after the additional continuous annealing.

As seen from FIGS. 6A and 6B, a remarkable improvement in magnetic characteristics was confirmed for steel A when the additional continuous annealing was performed in the high temperature range of not lower than 800° C., in particular, preferably not lower than 900° C. However, the effect of improving magnetic characteristics was almost saturated at a temperature of about 1050° C.

On the other hand, for steel B, the magnetic flux density was low regardless of the temperature of the additional continuous annealing, and a reduction in iron loss with the additional continuous annealing was hardly confirmed.

From the experiment described above, we found that the magnetic flux density and the iron loss were both improved by employing a starting material containing C in amount of not less than a certain value, performing decarburization annealing subsequent to the secondary recrystallization annealing, and further performing additional high-temperature continuous annealing in a non-oxidization atmosphere.

Next, an experiment was conducted by performing, after the above decarburization annealing, an additional batch annealing without applying an annealing separator under conditions that temperature was elevated to various temperatures at a rate of 50° C./h and held there for 20 hours in a nitrogen atmosphere with a dew point of −20° C.

Figure 7A:
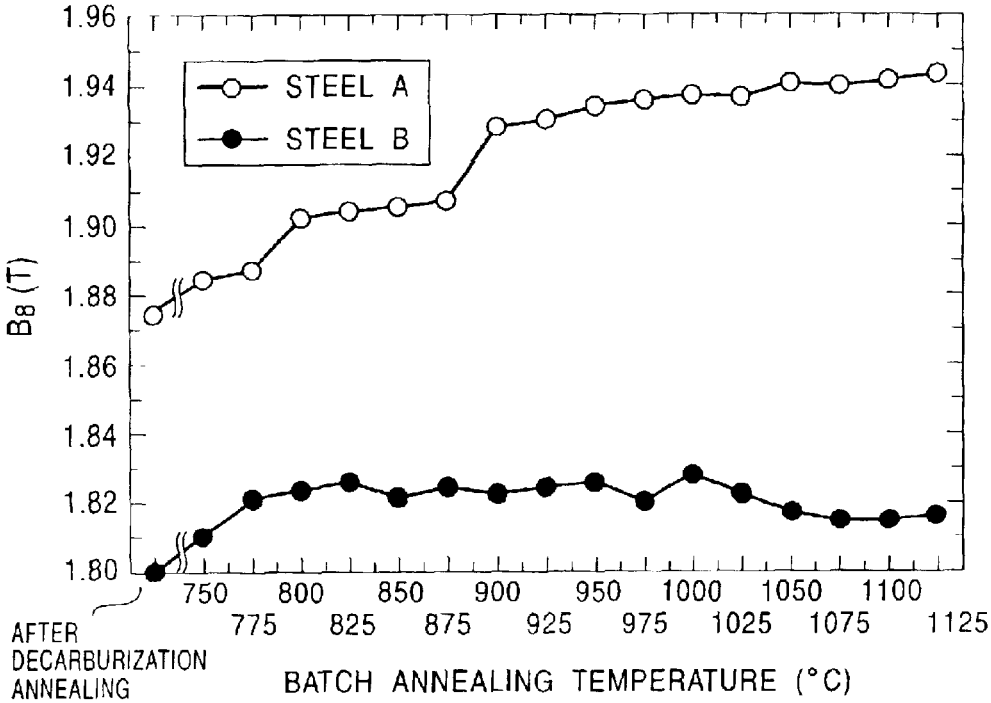
FIG. 7A is a graph showing changes of magnetic flux density ($B_8$) before and after additional batch annealing.
Figure 7B:
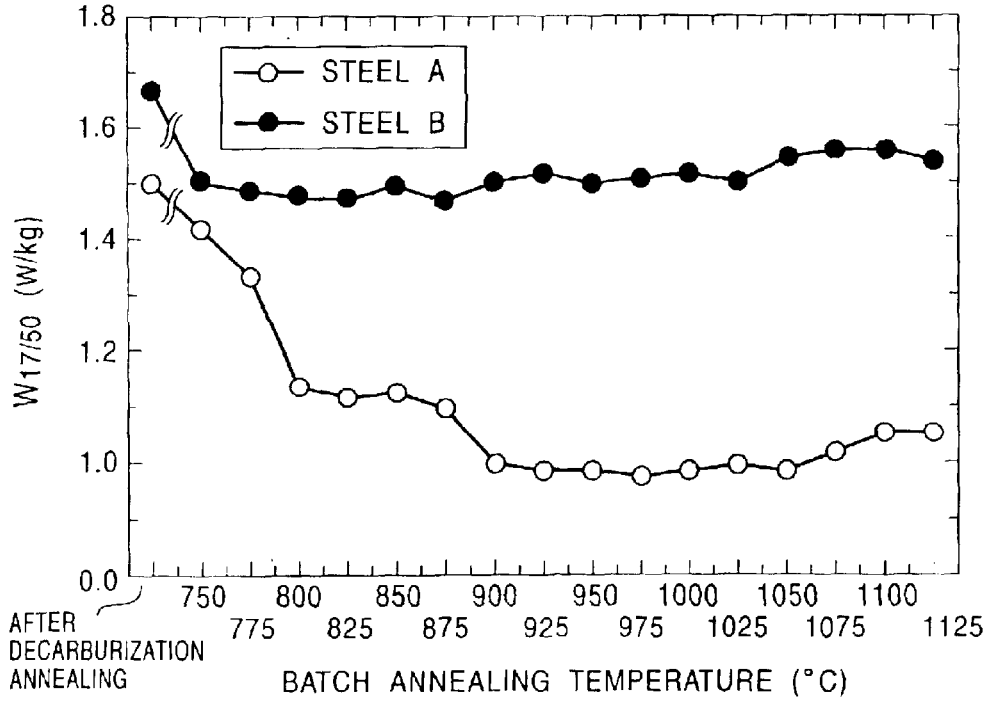
FIG. 7B is a graph showing changes of iron loss ($W_{17/50}$) before and after additional batch annealing.

FIGS. 7A and 7B show changes of magnetic characteristics before and after the additional batch annealing.

As seen from FIGS. 7A and 7B, a remarkable improvement in magnetic characteristics was confirmed for steel A when the additional batch annealing was performed in the high temperature range of not lower than 800° C., in particular, preferably not lower than 900° C.

Further, comparing FIGS. 7A and 7B with FIGS. 6A and 6B, the additional batch annealing provides a greater effect of reducing iron loss than the additional continuous annealing. However, the effect of improving magnetic characteristics was almost saturated at temperature of not lower than about 1050° C.

On the other hand, for steel B, the magnetic flux density was low and a reduction in iron loss with the additional batch annealing was also small.

The reason why much superior magnetic characteristics are obtained by performing decarburization annealing after the secondary recrystallization annealing and then performing additional continuous annealing or batch annealing at high temperature of not lower than 800° C. in a low-oxidization or non-oxidization atmosphere is not yet fully understood. However, such an advantageous result is presumably attributable to the fact that internal strains occurring in secondary recrystallization grains are released for some reason during the additional high temperature continuous annealing or batch annealing after the secondary recrystallization. Also, the remarkable effect of reducing iron loss is presumably obtained with the additional batch annealing for the reason that the steel sheet surface is smoothened by the thermal etching effect developed in addition to the above-mentioned effect of releasing internal strains, and the amount of nitrogen in steel is reduced as a result of performing the batch annealing in an atmosphere not containing nitrogen.

Moreover, since this invention is directed to a method of forming no forsterite coating during secondary recrystallization, the steel sheet can be easily decarburized with decarburization annealing (continuous annealing) performed in a humid atmosphere after secondary recrystallization annealing. Also, since the smooth surface is maintained with the invention, deterioration of iron loss is avoided.

A description is now made of the reasons why the composition of a slab, as a starting material, are limited to the above-mentioned ranges in the invention. Note that, unless otherwise specified, "%" and "ppm" used to indicate the contents of components represent respectively mass % and mass ppm. C: not more than about 0.08%

If the C content exceeds about 0.08% in the smelting stage, it is difficult to reduce the C content to about 0.025% or less with recrystallization annealing. Therefore, the C content is limited to be not more than about 0.08%. If the C content is too small, C: about 0.005% at least necessary after the recrystallization annealing could not easily be obtained (i.e. requires carbonization) and the magnetic flux density would be reduced. Therefore, a lower limit of the C content is preferably set to about 0.005%. The lower limit is more preferably about 0.006%, and even more preferably more than about 0.01%.

Also, it is preferable that the C content be not more than about 0.025% to mitigate the burden of decarburization required until the secondary recrystallization annealing or to omit the decarburization itself. Si: about 1.0 to about 8.0%

Si is an element useful for increasing the electrical resistance of steel and reducing iron loss. Therefore, Si of not less than about 1.0% should be contained. However, if the Si content exceeds about 8.0%, workability is greatly reduced and cold rolling is difficult to carry out. Hence, the Si content is limited to the range of about 1.0 to about 8.0%. When it is desired to further reduce the iron loss, the Si content is preferably not less than about 2.0%. Mn: about 0.005 to about 3.0%

Mn is an element useful for improving hot workability. If the Mn content is less than about 0.005%, the effect resulting from addition of Mn is insufficient. On the other hand, if the Mn content exceeds about 3.0%, the magnetic flux density is reduced. Therefore, the Mn content is limited to the range of about 0.005 to about 3.0%

Conventionally known inhibitors, such as AlN, MnSe and MnS, can also be used in the invention. However, it is particularly advantageous to implement the invention with a method of developing the secondary recrystallization without using any inhibitor, from the viewpoint of obtaining a lower iron loss with a simpler manufacturing process by omitting slab heating at high temperature to bring the inhibitor into a solid solution state and purification annealing at high temperature to remove the inhibitor.

In the case of not using the inhibitor, the content of Al as an inhibitor forming element is reduced to be not more than about 150 ppm, preferably not more than about 100 ppm, and N is reduced to be not more than about 50 ppm, preferably not more than about 30 ppm, for the purpose of developing satisfactory secondary recrystallization.

Also, S and Se as other inhibitor forming elements are advantageously reduced to be not more than about 50 ppm, preferably not more than about 30 ppm. Further, Ti, Nb, B, Ta, V, etc., as nitride forming elements, are each advantageously reduced to be not more than about 50 ppm for the purposes of preventing deterioration of the iron loss and ensuring good workability.

While the essential components and the components to be suppressed have been described above, the steel sheet according to the invention may further contain other elements given below, as required. These include at least one selected from among Ni: about 0.01 to about 1.50%, Sn: about 0.01 to about 0.50%, Sb: about 0.005 to about 0.50%, Cu: about 0.01 to about 0.50%, P: about 0.005 to about 0.50%, and Cr: about 0.01 to about 1.50%.

Ni is an element useful for remedying the texture of a hot-rolled sheet and then improving magnetic characteristics. However, if the Ni content is less than about 0.01%, improvement in the magnetic characteristics is insufficient. On the other hand, if the Ni content exceeds about 1.50%, the secondary recrystallization is unstable and the magnetic characteristics deteriorate. Therefore, the Ni content is limited to the range of about 0.01 to about 1.50%.

Also, Sn, Sb, Cu, P and Cr are each an element useful for reducing iron loss. For each of those elements, if the lower limit value of the above-mentioned range is not satisfied, the effect of reducing iron loss is insufficient. On the other hand, if the upper limit value thereof is exceeded, growth of secondary recrystallization grains is impeded. Therefore, those elements are preferably contained in the respective ranges of Sn: about 0.01 to about 0.50%, Sb: about 0.005 to about 0.50%, Cu: about 0.01 to about 0.50%, P: about 0.005 to about 0.50%, and Cr: about 0.01 to about 1.50%.

Further, Mo and Bi can also be added to improve the magnetic characteristics. Preferably, Mo and Bi are added, respectively, in the range of about 0.01 to about 0.30% and about 0.001 to about 0.01%.

The steel sheet is allowed to contain, in addition to the elements mentioned above, other incidental elements and inevitable impurities. In particular, Ca to be added for the purpose of desulfurization, etc. may be contained in amount of not more than about 0.001%.

To ensure good punching quality, it is a basic premise that an undercoating made of primarily forsterite ($Mg_2SiO_4$) is not formed on the steel sheet surface. Also, as mentioned above, removing forsterite once formed is not desired from the viewpoints of avoiding an increase of the cost and ensuring the smooth surface. For those reasons, the method of the invention is implemented in such a manner that a forsterite coating is not formed.

The manufacturing, process of the invention will be described below.

Molten steel adjusted to have a composition within the respective preferable ranges is refined by a well-known method using a converter, an electrical furnace or the like, and is subjected to vacuum treatment if necessary. Then, a slab is manufactured by an ordinary ingot-making method or continuous casting method. Alternatively, a thin cast piece with a thickness of not more than about 100 mm, for example, may be directly manufactured by a direct casting method.

The slab is heated by an ordinary method and subjected to hot rolling. As an alternative, the slab may be subjected to hot rolling immediately after casting without heating the slab. In the case of using a thin cast piece, the thin cast piece may be subjected to hot rolling or may be fed to subsequent steps without being subjected to hot rolling.

The slab heating temperature is generally in the range of about 1050 to about 1250° C. when no inhibitor is used, and in the range of about 1350 to about 1450° C. when an inhibitor is used. Also, the temperature at the end of hot rolling is generally in the range of about 750 to about 950° C.

Subsequently, the hot-rolled sheet is annealed as required. For highly developing the Goss ({110}<001>) structure in the product sheet, the annealing temperature for the hot-rolled sheet is preferably held in the range of about 800 to about 1100° C. In practice, preferably, in case of continuous annealing, annealing is performed in the range of about 900 to about 1100° C. for about 20 to about 180 seconds, and in case of batch annealing, annealing is performed in the range of about 800 to about 900° C. for about 2 hours or longer. A more preferable range of the annealing temperature is from about 800 to about 1000° C.

In case of developing the regular cubic ({100}<001>) structure in the product sheet, on the other hand, it is preferable that the annealing temperature for the hot-rolled sheet be held not lower than about 1000° C. and the grain size before the cold rolling be not smaller than about 150 μm.

After annealing the hot-rolled sheet (after hot rolling when the hot-rolled sheet is not annealed), the sheet is subjected to cold rolling such that it is finished to have a predetermined thickness (usually final sheet thickness). Cold rolling may be performed once. However, when an excessive burden is imposed on the rolling equipment to obtain the target sheet thickness with one pass of the cold rolling, cold rolling may be performed twice or more with intermediate annealing carried out there between for texture controlling of the sheet. A more preferable range of the annealing temperature is from about 800 to about 1000° C.

In case of developing the regular cubic When performing cold rolling, it is effective to elevate the rolling temperature to about 100 to about 250° C. during cold rolling or to perform an aging process (processing time: about 10 seconds to about 10 hours) one or more times in the range of about 100 to about 250° C. midway of the cold rolling from the viewpoint of developing the Goss structure or the regular cubic structure.

After the last pass of the cold rolling, the primary recrystallization annealing (so-called "recrystallization annealing") is usually performed as continuous annealing (time: about 5 to about 180 seconds).

The primary recrystallization annealing is preferably performed in the range of about 800 to about 1000° C. in a low-oxidization or non-oxidization atmosphere. Herein, the term "low-oxidization or non-oxidization atmosphere" means an atmosphere that does not contain oxygen essentially and has a dew point of not higher than about 40° C., preferably not higher than about 0° C. From an industrial point of view, an atmosphere of nitrogen, hydrogen or inert gas (such as Ar), or a mixed atmosphere thereof is conveniently used.

The most important point in ensuring a high magnetic flux density is to adjust the C content before the secondary recrystallization annealing (i.e. as primary-recrystallization-annealed in most cases) to be held in the range of abut 0.005 to about 0.025%.

More specifically, if the C content before the secondary recrystallization annealing is less than about 0.005%, the effect of improving the magnetic flux density with solid solution C is not obtained. On the other hand, if it exceeds about 0.025%, γ-transformation impedes growth of secondary recrystallization grains. In either case, therefore, the magnetic characteristics are greatly deteriorated.

The simplest method of controlling the C content resides in controlling the C content to be held in the above-mentioned range in the steel-making stage, and then performing all subsequent annealing steps in a non-decarburization atmosphere. However, when it is difficult to reduce the C content in the steel-making stage, decarburization may be performed such that the C content is reduced to fall in the proper range until secondary recrystallization annealing, by an alternative method of employing a humid hydrogen-containing atmosphere (dew point: not lower than about 20° C.) as an atmosphere for primary recrystallization annealing, annealing for the hot-rolled sheet, or intermediate annealing, and then performing the annealing for an appropriate time. The dew point of the atmosphere for primary recrystallization annealing is preferably not higher than about 40° C. for control of the C content. Of course, the method of controlling C content before secondary recrystallization annealing is not limited in above embodiments, and separate C controlling treatment can be performed after primary recrystallization annealing, or at any other chance before secondary recrystallization annealing.

Additionally, a technique for increasing the Si content in steel to about 6.5% with the silicon infiltrating process performed after final cold rolling or primary recrystallization annealing may be employed in a combined manner.

Thereafter, according to the invention, secondary recrystallization annealing (so-called "finishing annealing" or "final finishing annealing") is performed usually as batch annealing (time: about 1 to about 50 hours) in a low-oxidizative or non-oxidizative atmosphere. In this respect, it is a basic premise that an undercoating made primarily of forsterite ($Mg_2SiO_4$) is not formed on the steel sheet surface during the batch annealing, from the viewpoint of ensuring good punching quality, maintaining a uniform and smooth surface, and reducing iron loss. Herein, the expression "an undercoating made of primarily forsterite is not formed" means that, even when an undercoating is formed, the content of forsterite in the undercoating should be not more than about 0.1%.

Thus, for obtaining the uniform surface having no undercoating made primarily of forsterite ($Mg_2SiO_4$) (glass coating), it is particularly preferable to perform secondary recrystallization annealing, such as batch annealing, without applying (previously coating) an annealing separator.

An annealing separator is applied when such a high temperature as causing adhesion between coil layers is required to develop the secondary recrystallization. On that occasion, MgO, which forms forsterite, should not be used as a main component, and any of silica, alumina, zirconia, calcia, beryllia, titania, strontium oxide, chromia, barium oxide and the like is used instead. Herein, the expression "MgO should not be used as a main component" means that the MgO content in the annealing separator is not more than about 0.1%.

If the annealing separator is coated, it is effective to employ, e.g., electrostatic coating for the purposes of avoiding entrainment of moisture and suppressing generation of oxides. Alternatively, a sheet of a heat-resistant inorganic material (silica, alumina or mica) may be used.

Secondary recrystallization annealing is preferably performed at a temperature not lower than about 800° C. for encouraging secondary recrystallization, but a heating rate until reaching about 800° C. can be set to any desired value because it does not significantly affect the magnetic characteristics. On the other hand, the maximum reaching temperature is satisfactorily to be not higher than about 1000° C. when no inhibitor component is contained. When any inhibitor component is contained, the maximum reaching temperature in the secondary recrystallization annealing is preferably not lower than about 1100° C. for purification of the inhibitor component.

For developing the secondary recrystallization structure, it is very preferable that the atmosphere for secondary recrystallization annealing contain nitrogen at a nitrogen partial pressure of not lower than about 10 volume %. This is because such an atmosphere acts to accelerate the secondary recrystallization with the effect of suppressing migration of grain boundaries by the presence of solid solution nitrogen.

Further, for suppressing generation of oxides during secondary recrystallization annealing, it is important to use a non-oxidizative or low-oxidizative atmosphere. The non-oxidizative or low-oxidizative atmosphere is similarly defined as with that used for primary recrystallization annealing, but it is highly preferred that the dew point of the atmosphere not be higher than about 0° C. Even in the case of using a non-oxidizative atmosphere as the atmospheric gas, there is a risk that, if the dew point of the atmosphere is high, the amount of generated surface oxides is increased, thereby resulting in an increase in iron loss and deterioration in punching quality.

Decarburization annealing is performed after the end of secondary recrystallization. Decarburization annealing can be performed according to any of the following examples of process variations. However, the invention is not limited to those examples.

From the viewpoint of avoiding magnetic aging and obtaining a smaller iron loss, the decarburization process is preferably performed until the C content is reduced to a value less than about 50 mass ppm. More preferably, the C content is reduced to a value not more than about 30 mass ppm.

(1) After the end of secondary recrystallization in secondary recrystallization annealing (preferably after the annealing at temperature not lower than about 800° C. for about 5 hours or longer), decarburization progresses in succession. As a preferable condition, decarburization is progresses by introducing a hydrogen atmosphere and the annealing temperature reaching about 900° C. or higher. The progress of the decarburization reaction is slow if the temperature is lower than about 900° C. even if the hydrogen atmosphere is introduced. Therefore, the temperature while the hydrogen atmosphere is introduced is preferably not lower than about 900° C. Also, if the partial pressure of the hydrogen atmosphere is lower than about 10 volume %, the progress of the decarburization reaction is also slow. Therefore, the partial pressure of the hydrogen atmosphere is preferably not lower than about 10 volume %.

(2) While the sheet shape is generally corrected by performing flattening annealing (continuous annealing) after final finishing annealing as described later, flattening annealing may serve also as the decarburization annealing in the invention. The flattening annealing serving also as the decarburization annealing is preferably performed in a humid atmosphere. Particularly preferable processing conditions are given by an annealing temperature in the range of about 800 to about 1000° C. and the dew point of the atmosphere in the range of about 0 to about 40° C.

(3) It is also preferable to perform decarburization annealing as continuous annealing (time: about 20 to about 300 seconds) in a humid atmosphere (dew point: not lower than about 20° C.) after secondary recrystallization annealing. A temperature range of about 750 to about 950° C. is preferable to efficiently encourage the decarburization. Additionally, a technique for increasing the Si content with the silicon infiltrating process performed after decarburization annealing may be employed in a combined manner.

Preferably, additional (high-temperature) continuous annealing or additional (high-temperature) batch annealing is performed subsequent to the decarburization annealing for further improving the magnetic characteristics.

In the case of performing continuous annealing, the temperature is set to be not lower than about 800° C., preferably not lower than about 900° C., from the viewpoint of improving the magnetic characteristics. In the high-temperature continuous annealing, an upper limit temperature is not set to a particular value, but if the temperature exceeds about 1050° C., an improvement in the magnetic characteristics would be saturated. It is, therefore, advantageous to hold the temperature not to be higher than about 1050° C. from an economical efficiency standpoint. Also, the residing time at temperature of not lower than about 800° C. in the continuous annealing is preferably about 10 seconds or longer for removing residual strains and improving the magnetic characteristics. Further, a low-oxidizative or non-oxidizative atmosphere (which is similarly defined as with that used for primary recrystallization annealing) is preferably used as the atmosphere for continuous annealing from the viewpoint of suppressing surface oxidization and maintaining iron loss at a satisfactory level.

Additional continuous annealing after decarburization annealing may be performed in a separate line in such a manner that flattening annealing is simultaneously effectuated. However, it is more efficient to perform, in one line, decarburization annealing in a humid atmosphere in the first half of the line and a high-temperature annealing in a low-oxidizative or non-oxidizative atmosphere in the second half of the line, because the sheet shape can be corrected and flattened by applying a tension (about 2 to about 6 MPa) at the same time.

Also, in the case of performing additional high-temperature batch annealing after decarburization annealing, the temperature is preferably set not to be lower than about 800° C. for reducing iron loss. Because of the necessity of performing annealing for about 5 hours or longer in the additional batch annealing, if an upper limit of the annealing temperature exceeds about 1050° C., generation of surface oxides is inevitable and punching quality is deteriorated. Therefore, the temperature is preferably set not to be higher than about 1050° C. Further, at a temperature exceeding about 1050° C., the effect of reducing the iron loss would be saturated. It is, hence, advantageous to hold the temperature not to be higher than about 1050° C. from an economical efficiency standpoint. Also, the residence time at a temperature of not lower than about 800° C. in the additional batch annealing is preferably at least about 5 hours to maintain iron loss at a satisfactory level.

While it is preferable not to apply an annealing separator in the additional batch annealing as well, the annealing separator containing no MgO, which is usable in the secondary recrystallization annealing performed in the invention, may be applied, if necessary, for preventing seizure and the like.

Flattening annealing can be performed to correct the sheet shape after secondary recrystallization annealing or after additional batch annealing. Unless otherwise specified, flattening annealing is preferably performed in a dried atmosphere from the viewpoint of suppressing surface oxidization and maintaining the iron loss at a satisfactory level.

After flattening annealing (or after finishing annealing or additional annealing when flattening can be omitted), an insulating coating can be formed on surfaces of the steel sheet. Although sub-scales are often formed on the sheet surface after the flattening annealing, an insulating coating may be formed while leaving the sub-scales as they are. An organic or semi-organic coating containing a resin is preferably formed to ensure good punching quality. An inorganic coating may be formed when primary importance is focused on weldability.

The insulating coating is preferably formed by a method of applying a solution for the insulating coating over the steel sheet and baking it at temperature in the range of about about 100 to about 400° C. The above-mentioned flattening annealing may be performed after applying the coating solution so that the flattening annealing serves also to bake the insulating coating.

The grain-oriented electrical steel sheet of the invention is optimally used for large-sized motors and (large-sized) generators in which primary importance focuses on punching quality, but it is not limited to those applications because of having a high magnetic flux density in the rolling direction. In other words, the grain-oriented electrical steel sheet of the invention is applicable to all areas of applications where grain-oriented electrical steel sheets, particularly grain-oriented electrical steel sheets in which primary importance focuses on punching quality, are employed. The method of performing additional batch annealing after decarburization annealing is especially advantageous in that a very low iron loss is obtained.

Moreover, when no inhibitor is contained in raw materials, a great advantage of enabling mass-production to be performed at a relatively inexpensive cost is obtained because there is no need to perform high-temperature heating of the slab and high-temperature purification annealing.

EXAMPLES

Example 1

Steel slabs having material compositions shown in Table 1 were manufactured by continuous casting. Contents of all other components than those shown in Table 1 were each reduced to be not more than 50 ppm. After heating each slab at 1030° C. for 20 minutes, the slab was subjected to hot rolling to obtain a hot-rolled sheet with a thickness of 2.2 mm. The hot-rolled sheet was then annealed under soaking at 1000° C. for 30 seconds. Thereafter, the hot-rolled sheet was subjected to cold rolling at ambient temperature to obtain a cold-rolled sheet with a final thickness of 0.30 mm.

Subsequently, the cold-rolled sheet was subjected to primary recrystallization annealing under soaking at 930° C. for 10 seconds in an atmosphere that contained 25 volume percent (volume %) of hydrogen and 75 volume % of nitrogen and had a dew point of −30° C. Then, secondary recrystallization annealing (final finishing annealing) was performed in a mixed atmosphere (dew point: −30° C.) of 50 volume % of nitrogen and 50 volume % of Ar without applying an annealing separator under conditions that temperature was elevated to 800° C. at a rate of 50° C./h, then elevated from 800° C. to 880° C. at a rate of 10° C./h, and was held there for 50 hours.

After the secondary recrystallization annealing, flattening annealing serving also as decarburization was performed at 875° C. for 60 seconds in a humid hydrogen atmosphere with a dew point of 30° C. while applying a tension of 4 MPa to the steel sheet, whereby the C content in the steel was reduced to 0.0030% or below.

Then, a coating solution prepared as a mixture of aluminum bichromate, emulsion resin and ethylene glycol was coated over the steel sheet and baked at 300° C. A product sheet was thus obtained.

The thus-obtained product sheet was measured for magnetic flux density ($B_8$) and iron loss ($W_{17/50}$) in the rolling direction. Note that $B_8$ represents magnetic flux density at a magnetizing force of 800 A/m, and $W_{17/50}$ represents a value of iron loss at a frequency of 50 Hz and a maximum magnetic flux density of 1.7T.

Further, for evaluation of punching quality, the product sheet was successively punched until a burr height (height from the smooth sheet surface on the side, in which a burr is present, to the burr tip) reached 50 $\mu$m, by using a 50-ton press and a commercially available punching oil under conditions of a die punching diameter of 50 mmϕ (material: SKD-11: stipulated by JIS G 4404-1983), a punching rate of 350 strokes/minute, and a clearance of 6%.

The results obtained are shown in Table 1.

Example 2

Steel slabs having material compositions shown in Table 2 were each heated to 1125° C. and then subjected to hot rolling to obtain a hot-rolled sheet with a thickness of 2.8 mm. Contents of all other components than those shown in Table 2 were each reduced not to be more than 50 ppm.

The hot-rolled sheet was annealed under soaking at 1000° C. for 60 seconds and then subjected to cold rolling to obtain a cold-rolled sheet with a final thickness of 0.30 mm. Subsequently, the cold-rolled sheet was subjected to primary recrystallization annealing under soaking at 920° C. for 20 seconds in an atmosphere that contained 50 volume percent (volume %) of hydrogen and 50 volume % of nitrogen and had the dew point of −50° C. Then, secondary recrystallization annealing (final finishing annealing) was performed in a nitrogen atmosphere with a dew point of −40° C. without applying an annealing separator under conditions that temperature was elevated to 900° C. at a rate of 10° C./h and was held at 900° C. for 75 hours.

After secondary recrystallization annealing, flattening annealing serving also as decarburization was performed at 875° C. for 60 seconds in a humid hydrogen atmosphere with a dew point of 35° C. while applying a tension of 4 MPa to the steel sheet, whereby the C content in the steel was reduced to 0.0030% or below.

Then, a coating solution prepared as a mixture of aluminum bichromate, emulsion resin and ethylene glycol was coated over the steel sheet and baked at 300° C. A product sheet was thus obtained.

The thus-obtained product sheet was measured for magnetic flux density ($B_8$) and iron loss ($W_{17/50}$) in the rolling direction.

TABLE 1

| | Material Components (mass %, ppm)* | | | | | | C Content after Primary Recrystallization Annealing | Rolling Direction of Product Sheet | | Number of Times of | |
|---|---|---|---|---|---|---|---|---|---|---|---|
| No. | C | Si | Mn | Sb | Al | N | (mass %) | $B_8$ (T) | $W_{17/50}$ (W/kg) | Punching | Remarks |
| 1 | 0.008 | 3.3 | 0.04 | 0.03 | 20 | 12 | 0.006 | 1.905 | 1.10 | >3 million | Inventive Example |
| 2 | 0.013 | 3.3 | 0.05 | 0.03 | 25 | 10 | 0.010 | 1.908 | 1.05 | >3 million | Inventive Example |
| 3 | 0.018 | 3.3 | 0.06 | 0.03 | 30 | 7 | 0.016 | 1.915 | 1.07 | >3 million | Inventive Example |
| 4 | 0.025 | 3.3 | 0.04 | 0.03 | 45 | 12 | 0.021 | 1.905 | 1.10 | >3 million | Inventive Example |
| 5 | 0.005 | 3.3 | 0.05 | 0.03 | 40 | 20 | 0.003 | 1.855 | 1.30 | >3 million | Comparative Example |
| 6 | 0.035 | 3.3 | 0.04 | 0.03 | 30 | 13 | 0.030 | 1.578 | 2.13 | >3 million | Comparative Example |
| 7 | commercially available general grain-oriented electrical steel sheet | | | | | | | 1.855 | 1.33 | 0.1 million | Conventional Example |

*Al and N are expressed in ppm

As seen from Table 1, by performing the secondary recrystallization annealing in the state where C remains in amount of 0.005 to 0.025% after primary recrystallization annealing, a product sheet having a superior magnetic flux density in the rolling direction and good punching quality can be obtained.

Further, for evaluation of punching quality, the product sheet was successively punched until the burr height reached 50 $\mu$m, by using a 50-ton press and a commercially available punching oil under conditions of a die punching diameter of 50 mmϕ (material: SKD-11), a punching rate of 350 strokes/minute, and a clearance of 6%.

The results obtained are shown in Table 2.

TABLE 2

| No. | Material Components (mass %, ppm)* C | Si | Mn | Ni | Sn | Sb | Cu | P | Cr | Al | N | C Content after Primary Recrystallization Annealing (mass %) | Rolling Direction of Product Sheet $B_8$ (T) | $W_{17/50}$ (W/kg) | Number of Times of Punching | Remarks |
|---|---|---|---|---|---|---|---|---|---|---|---|---|---|---|---|---|
| 1 | 0.023 | 3.3 | 0.14 | tr | tr | tr | tr | tr | tr | 30 | 14 | 0.020 | 1.885 | 1.18 | >3 million | Inventive Example |
| 2 | 0.022 | 3.2 | 0.13 | 0.6 | tr | 0.02 | tr | tr | tr | 55 | 20 | 0.021 | 1.923 | 1.05 | >3 million | Inventive Example |
| 3 | 0.015 | 3.3 | 0.21 | tr | 0.04 | tr | tr | tr | tr | 70 | 5 | 0.013 | 1.897 | 1.08 | >3 million | Inventive Example |
| 4 | 0.020 | 3.4 | 0.12 | tr | tr | 0.03 | 0.2 | tr | tr | 45 | 21 | 0.019 | 1.908 | 1.10 | >3 million | Inventive Example |
| 5 | 0.012 | 3.4 | 0.10 | tr | tr | 0.03 | tr | 0.03 | tr | 20 | 20 | 0.011 | 1.893 | 1.11 | >3 million | Inventive Example |
| 6 | 0.020 | 3.4 | 0.22 | tr | tr | 0.03 | tr | tr | 0.5 | 40 | 15 | 0.019 | 1.887 | 1.09 | >3 million | Inventive Example |
| 7 | 0.014 | 3.3 | 0.13 | tr | tr | tr | tr | tr | tr | 250 | 10 | 0.010 | 1.553 | 2.66 | >3 million | Comparative Example |
| 8 | 0.021 | 3.3 | 0.13 | tr | tr | tr | tr | tr | tr | 50 | 70 | 0.019 | 1.577 | 2.38 | >3 million | Comparative Example |

*Al and N are expressed in ppm

As seen from Table 2, by performing secondary recrystallization annealing using a starting material, which has the composition according to the invention, in the state where C remains in amount of 0.005 to 0.025%, a product sheet having a superior magnetic flux density in the rolling direction and good punching quality can be obtained.

Example 3

A steel slab having a composition containing C: 0.030%, Si: 3.3%, Mn: 0.05%, Sb: 0.02%, and the balance consisting of Fe and inevitable impurities, in which contents of sol. Al, N and each of all other components were reduced to be not more than 40 ppm, 20 ppm and 50 ppm, respectively, was manufactured by continuous casting. After heating the slab at 1100° C. for 30 minutes, the slab was subjected to hot rolling to obtain a hot-rolled sheet with a thickness of 3.2 mm. The hot-rolled sheet was then annealed under conditions shown in Table 3. Thereafter, the hot-rolled sheet was subjected to cold rolling at temperature of 250° C. to obtain a cold-rolled sheet with a final thickness of 0.50 mm.

Subsequently, the cold-rolled sheet was subjected to primary recrystallization annealing under soaking at 900° C. for 30 seconds in a mixed atmosphere that contained 75 volume percent (volume %) of nitrogen and 25 volume % of hydrogen and had a dew point of 30° C. Then, final finishing annealing was performed by a method of heating the steel sheet to 1000° C. at a rate of 50° C./h in a nitrogen atmosphere with a dew point of −20° C. while applying colloidal silica as an annealing separator.

After final finishing annealing, flattening annealing serving also as decarburization was performed at 850° C. for 60 seconds in a humid hydrogen atmosphere with a dew point of 50° C. while applying a tension of 8 MPa to the steel sheet, whereby the C content in the steel was reduced to 0.0030% or below.

Then, a coating solution prepared as a mixture of phosphorous aluminum, acryl, styrene resin and boric acid was coated over the steel sheet and baked at 300° C. A product sheet was thus obtained.

The thus-obtained product sheet was measured for magnetic flux density ($B_8$) and iron loss ($W_{15/50}$) in both the rolling direction and a direction perpendicular to the rolling direction.

Further, for evaluation of punching quality, the product sheet was successively punched until the burr height reached 50 μm, by using a 50-ton press and a commercially available punching oil under conditions of a die punching diameter of 50 mmϕ (material: SKD-11), a punching rate of 350 strokes/minute, and a clearance of 6%.

The results obtained are shown in Table 3.

TABLE 3

| No. | Annealing of Hot-Rolled Sheet temperature (° C.) | time (s) | After Primary Recrystallization Annealing Grain size (μm) | C content (mass %) | Rolling Direction of Product Sheet $B_8$ (T) | $W_{15/50}$ (W/kg) | Direction Perpendicular to Rolling Direction of Product Sheet $B_8$ (T) | $W_{15/50}$ (W/kg) | Number of Times of Punching | Remarks |
|---|---|---|---|---|---|---|---|---|---|---|
| 1 | 900 | 60 | 80 | 0.013 | 1.88 | 1.10 | 1.35 | 2.35 | >3 million | Inventive Example |
| 2 | 1000 | 60 | 130 | 0.012 | 1.86 | 1.13 | 1.55 | 1.99 | >3 million | Inventive Example |

TABLE 3-continued

| No. | Annealing of Hot-Rolled Sheet temperature (° C.) | Annealing of Hot-Rolled Sheet time (s) | After Primary Recrystallization Annealing Grain size (μm) | After Primary Recrystallization Annealing C content (mass %) | Rolling Direction of Product Sheet $B_8$ (T) | Rolling Direction of Product Sheet $W_{15/50}$ (W/kg) | Direction Perpendicular to Rolling Direction of Product Sheet $B_8$ (T) | Direction Perpendicular to Rolling Direction of Product Sheet $W_{15/50}$ (W/kg) | Number of Times of Punching | Remarks |
|---|---|---|---|---|---|---|---|---|---|---|
| 3 | 1050 | 60 | 280 | 0.011 | 1.84 | 1.17 | 1.66 | 1.75 | >3 million | Inventive Example |
| 4 | 1100 | 60 | 350 | 0.011 | 1.83 | 1.23 | 1.75 | 1.44 | >3 million | Inventive Example |

As seen from Table 3, any of the steel sheets manufactured by the method of the invention has superior magnetic characteristics in the rolling direction. Particularly, by annealing the hot-rolled sheet at temperature not lower than 1000° C., the product sheet having not only superior magnetic characteristics in the rolling direction, but also in the direction perpendicular to the rolling direction.

Example 4

Steel slabs having material compositions shown in Table 4 were manufactured by continuous casting. Contents of all other components than those shown in Table 4 were each reduced to be not more than 50 ppm. After heating each slab to 1080° C., the slab was subjected to hot rolling to obtain a hot-rolled sheet with a thickness of 2.3 mm. The hot-rolled sheet was annealed under soaking at 850° C. for 30 seconds and then subjected to cold rolling at the normal temperature to obtain a cold-rolled sheet with a final thickness of 0.34 mm.

Subsequently, the cold-rolled sheet was subjected to primary recrystallization annealing under soaking at 930° C. for 10 seconds in an atmosphere that contained 25 volume percent (volume %) of hydrogen and 75 volume % of nitrogen and had a dew point of −30° C. Thereafter, secondary recrystallization annealing—decarburization annealing (final finishing annealing) was performed without applying an annealing separator under conditions that temperature was elevated to 800° C. at a rate of 50° C./h, then elevated from 800° C. to 880° C. at a rate of 10° C./h, and was held there for 50 hours in a mixed atmosphere (the dew point: −20° C.) containing 50 volume % of nitrogen and 50 volume % of Ar, following which temperature was further elevated to 1070° C. at a rate of 10° C./h after replacement with a hydrogen atmosphere with a dew point of −30° C. After the secondary recrystallization annealing—the decarburization annealing, the C content in each steel sheet was reduced to 0.0030% or below.

Then, flattening annealing was performed at 875° C. for 60 seconds in a mixed atmosphere of dried nitrogen—hydrogen (50 volume %−50 volume %) while applying a tension of 3 MPa to the steel sheet, whereby the steel shape was corrected. Thereafter, a coating solution prepared as a mixture of aluminum bichromate, emulsion resin and ethylene glycol was coated over the steel sheet and baked at 300° C. A product sheet was thus obtained.

The thus-obtained product sheet was measured for magnetic flux density ($B_8$) and iron loss ($W_{17/50}$) in the rolling direction.

Further, for evaluation of punching quality, the product sheet was successively punched until the burr height reached 50 μm, by using a 50-ton press and a commercially available punching oil under conditions of a die punching diameter of 50 mmϕ (material: SKD-11), a punching rate of 350 strokes/minute, and a clearance of 6%.

The results obtained are shown in Table 4.

TABLE 4

| No. | Material Components (mass %, ppm)* C | Si | Mn | Sb | Al | N | C Content after Primary Recrystallization Annealing (mass %) | C Content after Secondary Recrystallization Annealing (mass %) | Rolling Direction of Product Sheet $B_8$ (T) | Rolling Direction of Product Sheet $W_{17/50}$ (W/kg) | Number of Times of Punching (× $10^4$) | Remarks |
|---|---|---|---|---|---|---|---|---|---|---|---|---|
| 1 | 0.008 | 3.3 | 0.04 | 0.03 | 20 | 12 | 0.006 | 0.002 | 1.935 | 0.98 | >300 | Inventive Example |
| 2 | 0.013 | 3.3 | 0.05 | 0.03 | 25 | 10 | 0.010 | 0.002 | 1.938 | 0.94 | >300 | Inventive Example |
| 3 | 0.018 | 3.3 | 0.06 | 0.03 | 30 | 7 | 0.016 | 0.003 | 1.945 | 0.91 | >300 | Inventive Example |
| 4 | 0.025 | 3.3 | 0.04 | 0.03 | 45 | 12 | 0.021 | 0.003 | 1.935 | 0.96 | >300 | Inventive Example |
| 5 | 0.005 | 3.3 | 0.05 | 0.03 | 40 | 20 | 0.003 | 0.002 | 1.835 | 1.30 | >300 | Comparative Example |
| 6 | 0.035 | 3.3 | 0.04 | 0.03 | 30 | 13 | 0.030 | 0.004 | 1.567 | 2.10 | >300 | Comparative Example |
| 7 | commercially available general grain-oriented electrical steel sheet | | | | | | | | 1.855 | 1.33 | 5 | Conventional Example |

*Al and N are expressed in ppm

As seen from Table 4, by performing secondary recrystallization annealing in the state where C remains in amount of 0.005 to 0.025% after primary recrystallization annealing, and then performing the decarburizing process in a high-temperature range, a product sheet being superior in both magnetic flux density and iron loss and having good punching quality can be obtained.

punching oil under conditions of a die punching diameter of 50 mmϕ (material: SKD-11), a punching rate of 350 strokes/minute, and a clearance of 6%.

The results obtained are shown in Table 5.

TABLE 5

| | Material Components (mass %, ppm)* | | | | | | | | | | | C Content after Primary Recrystallization Annealing | Rolling Direction of Product Sheet | | Number of Times of Punching | |
|---|---|---|---|---|---|---|---|---|---|---|---|---|---|---|---|---|
| No. | C | Si | Mn | Ni | Sn | Sb | Cu | P | Cr | Al | N | (mass %) | $B_8$ (T) | $W_{17/50}$ (W/kg) | (× $10^4$) | Remarks |
| 1 | 0.023 | 3.3 | 0.14 | tr | tr | tr | tr | tr | tr | 30 | 14 | 0.020 | 1.925 | 0.98 | >300 | Inventive Example |
| 2 | 0.022 | 3.2 | 0.13 | 0.6 | tr | 0.02 | tr | tr | tr | 55 | 20 | 0.021 | 1.933 | 0.95 | >300 | Inventive Example |
| 3 | 0.015 | 3.3 | 0.21 | tr | 0.04 | tr | tr | tr | tr | 70 | 5 | 0.013 | 1.930 | 0.93 | >300 | Inventive Example |
| 4 | 0.020 | 3.4 | 0.12 | tr | tr | 0.03 | 0.2 | tr | tr | 45 | 21 | 0.019 | 1.940 | 0.93 | >300 | Inventive Example |
| 5 | 0.012 | 3.4 | 0.10 | tr | tr | 0.03 | tr | 0.03 | tr | 20 | 20 | 0.011 | 1.933 | 0.95 | >300 | Inventive Example |
| 6 | 0.020 | 3.4 | 0.22 | tr | tr | 0.03 | tr | tr | 0.5 | 40 | 15 | 0.019 | 1.927 | 0.94 | >300 | Inventive Example |

*Al and N are expressed in ppm

Example 5

Steel slabs having material compositions shown in Table 5 were each heated to 1125° C. and then subjected to hot rolling to obtain a hot-rolled sheet with a thickness of 2.8 mm. Contents of all other components than those shown in Table 5 were each reduced not to be more than 50 ppm. The hot-rolled sheet was annealed under soaking at 1000° C. for 60 seconds and then subjected to cold rolling to obtain a cold-rolled sheet with a final thickness of 0.34 mm.

Subsequently, the cold-rolled sheet was subjected to primary recrystallization annealing under soaking at 900° C. for 20 seconds in an atmosphere that contained 50 volume percent (volume %) of hydrogen and 50 volume % of nitrogen and had a dew point of −50° C. Thereafter, secondary recrystallization annealing—decarburization annealing (final finishing annealing) was performed without applying an annealing separator under conditions that temperature was elevated to 900° C. at a rate of 10° C./h and was held there for 75 hours, following which temperature was further elevated to 1000° C. at a rate of 10° C./h after replacement with a hydrogen atmosphere with a dew point of −20° C. After secondary recrystallization annealing—decarburization annealing (final finishing annealing), the C content in each steel sheet was reduced to 0.0030% or below.

Then, flattening annealing was performed at 875° C. for 60 seconds in a hydrogen atmosphere with a dew point of −35° C. while applying a tension of 2.5 MPa to the steel sheet, whereby the sheet shape was corrected. Thereafter, a coating solution prepared as a mixture of aluminum bichromate, emulsion resin and ethylene glycol was coated over the steel sheet and baked at 300° C. A product sheet was thus obtained.

The thus-obtained product sheet was measured for magnetic flux density (B8) and iron loss ($W_{17/50}$) in the rolling direction.

Further, for evaluation of punching quality, the product sheet was successively punched until the burr height reached 50 μm, by using a 50-ton press and a commercially available As seen from Table 5, by performing the secondary recrystallization annealing using a workpiece material, which has the composition according to the invention, in the state where C remains in an amount of 0.005 to 0.025%, a product sheet being superior in both magnetic flux density and iron loss and having good punching quality can be obtained.

Example 6

Steel slabs having material compositions including inhibitor components, shown in Table 6, were each heated to temperature as high as 1280° C. and then subjected to hot rolling to obtain a hot-rolled sheet with a thickness of 2.2 mm. Contents of all other components than those shown in Table 6 were each reduced not to be more than 50 ppm. The hot-rolled sheet was annealed under soaking at 900° C. for 30 seconds and then subjected to cold rolling at 250° C. to obtain a cold-rolled sheet with a final thickness of 0.26 mm.

Subsequently, the cold-rolled sheet was subjected to primary recrystallization annealing under soaking at 900° C. for 30 seconds in a mixed atmosphere that contained 25 volume percent (volume %) of nitrogen and 75 volume % of hydrogen and had a dew point of −30° C. Thereafter, secondary recrystallization annealing—decarburization annealing (final finishing annealing) was performed while applying colloidal silica as an annealing separator under conditions that temperature was elevated to 900° C. at a rate of 50° C./h and was held there for 20 hours in a nitrogen atmosphere with a dew point of −20° C., following which temperature was further elevated to 1150° C. at a rate of 50° C./h after replacement with a hydrogen atmosphere with the dew point of −20° C. After secondary recrystallization annealing—decarburization annealing (final finishing annealing), the C content in each steel sheet was reduced to 0.0030% or below.

Then, flattening annealing was performed at 900° C. for 10 seconds in a mixed atmosphere of nitrogen and hydrogen with a dew point of −20° C. while applying a tension of 4 MPa to the steel sheet, whereby the sheet shape was corrected. Thereafter, a coating solution prepared as a mixture of phosphorous aluminum, acryl, styrene resin and boric acid was coated over the steel sheet and baked at 300° C. A product sheet was thus obtained.

The thus-obtained product sheet was measured for magnetic flux density ($B_8$) and iron loss ($W_{17/50}$) in the rolling direction.

Further, for evaluation of punching quality, the product sheet was successively punched until the burr height reached 50 μm, by using a 50-ton press and a commercially available punching oil under conditions of a die punching diameter of 50 mmϕ (material: SKD-11), a punching rate of 350 strokes/minute, and a clearance of 6%.

The results obtained are shown in Table 6.

TABLE 6

| | Material Components (mass %, ppm)* | | | | | | | C Content after Primary Recrystallization Annealing | Rolling Direction of Product Sheet | | Number of Times of Punching | |
|---|---|---|---|---|---|---|---|---|---|---|---|---|
| No. | C | Si | Mn | S | Se | Al | N | (mass %) | $B_8$ (T) | $W_{17/50}$ (W/kg) | (× $10^4$) | Remarks |
| 1 | 0.025 | 3.3 | 0.04 | 0.012 | tr | 20 | 21 | 0.023 | 1.895 | 0.90 | >300 | Inventive Example |
| 2 | 0.027 | 3.2 | 0.04 | 0.003 | 0.012 | 24 | 15 | 0.024 | 1.923 | 0.88 | >300 | Inventive Example |
| 3 | 0.023 | 3.3 | 0.05 | 0.002 | tr | 140 | 65 | 0.022 | 1.937 | 0.85 | >300 | Inventive Example |
| 4 | 0.025 | 3.4 | 0.05 | 0.002 | 0.010 | 110 | 60 | 0.023 | 1.938 | 0.84 | >300 | Inventive Example |

*Al and N are expressed in ppm

As seen from Table 6, by performing secondary recrystallization annealing using a starting material, which has the composition according to the invention, in the state where C remains in amount of 0.005 to 0.025%, the product sheet being superior in both magnetic flux density and iron loss and having good punching quality can be obtained.

Example 7

Steel slabs having material compositions shown in Table 7 were manufactured by continuous casting. Contents of all other components than those shown in Table 7 were each reduced not to be more than 50 ppm. After heating each slab at 1050° C. for 60 minutes, the slab was subjected to hot rolling to obtain a hot-rolled sheet with a thickness of 2.8 mm. The hot-rolled sheet was annealed under soaking at 900° C. for 20 seconds and then subjected to cold rolling at the normal temperature to obtain a cold-rolled sheet with a final thickness of 0.34 mm.

Subsequently, the cold-rolled sheet was subjected to primary recrystallization annealing under soaking at 950° C. for 5 seconds in an atmosphere that contained 35 volume percent (volume %) of hydrogen and 65 volume % of nitrogen and had a dew point of −40° C. Thereafter, secondary recrystallization annealing was performed in a nitrogen atmosphere without applying an annealing separator under conditions that temperature was elevated to 800° C. at a rate of 50° C./h, then elevated from 800° C. to 900° C. at a rate of 10° C./h, and was held there for 50 hours.

After secondary recrystallization annealing, decarburization annealing was performed at 835° C. for 60 seconds in a humid hydrogen atmosphere with a dew point of 40° C., whereby the C content in the steel was reduced to 0.0030% or below.

Then, additional continuous annealing serving also as flattening annealing was performed at 980° C. for 10 seconds in a mixed atmosphere of 25 volume % of hydrogen and 75 volume % nitrogen (dew point: −40° C.).

After the flattening annealing, a coating solution prepared as a mixture of aluminum bichromate, emulsion resin and ethylene glycol was coated over the steel sheet and baked at 300° C. A product sheet was thus obtained.

The thus-obtained product sheet was measured for magnetic flux density ($B_8$) and iron loss ($W_{17/50}$) in the rolling direction.

The results obtained are shown in Table 7.

TABLE 7

| No. | Material Components (mass %, ppm)* C | Si | Mn | Sb | Al | N | C Content after Primary Recrystallization Annealing (mass %) | Rolling Direction of Product Sheet $B_8$ (T) | $W_{17/50}$ (W/kg) | Remarks |
|---|---|---|---|---|---|---|---|---|---|---|
| 1 | 0.007 | 3.3 | 0.04 | 0.02 | 30 | 11 | 0.006 | 1.895 | 1.20 | Inventive Example |
| 2 | 0.012 | 3.3 | 0.05 | 0.02 | 30 | 15 | 0.010 | 1.928 | 1.15 | Inventive Example |
| 3 | 0.018 | 3.3 | 0.06 | 0.02 | 30 | 12 | 0.016 | 1.935 | 1.10 | Inventive Example |
| 4 | 0.024 | 3.3 | 0.04 | 0.02 | 40 | 14 | 0.021 | 1.930 | 1.12 | Inventive Example |
| 5 | 0.005 | 3.3 | 0.05 | 0.02 | 40 | 20 | 0.002 | 1.850 | 1.40 | Comparative Example |
| 6 | 0.035 | 3.3 | 0.04 | 0.02 | 30 | 13 | 0.033 | 1.578 | 1.95 | Comparative Example |
| 7 | commercially availablegeneral grain-oriented electrical steel sheet | | | | | | | 1.855 | 1.35 | Conventional Example |

*Al and N are expressed in ppm

As seen from Table 7, by performing the secondary recrystallization annealing in the state where C remains in amount of 0.005 to 0.025%, and after decarburization annealing, performing additional continuous annealing at high temperature of not lower than 800° C. in a low-oxidization or non-oxidization atmosphere, a product sheet being superior in both magnetic flux density and iron loss in the rolling direction and not having an undercoating made of primarily forsterite ($Mg_2SiO_4$) (glass coating) can be obtained.

Example 8

Steel slabs were each processed until the decarburization annealing step under the same conditions as those in Example 7. Subsequently, the steel sheet was subjected to, without applying an annealing separator, additional batch annealing in a hydrogen atmosphere (dew point: −25° C.) under conditions that temperature was elevated to 1050° C. at a rate of 50° C./h and was held there for 5 hours.

Then, continuous annealing serving as flattening annealing was performed at 900° C. for 10 seconds in a hydrogen atmosphere with a dew point of −30° C. After flattening annealing, a coating solution prepared as a mixture of aluminum bichromate, emulsion resin and ethylene glycol was coated over the steel sheet and baked at 300° C. A product sheet was thus obtained.

The thus-obtained product sheet was measured for magnetic flux density ($B_8$) and iron loss ($W_{17/50}$) in the rolling direction. The results obtained are shown in Table 8.

TABLE 8

| No. | Material Components (mass %, ppm)* C | Si | Mn | Sb | Al | N | C Content after Primary Recrystallization Annealing (mass %) | Rolling Direction of Product Sheet $B_8$ (T) | $W_{17/50}$ (W/kg) | Remarks |
|---|---|---|---|---|---|---|---|---|---|---|
| 1 | 0.007 | 3.3 | 0.04 | 0.02 | 30 | 11 | 0.006 | 1.915 | 1.05 | Inventive Example |
| 2 | 0.012 | 3.3 | 0.05 | 0.02 | 30 | 15 | 0.010 | 1.940 | 1.00 | Inventive Example |
| 3 | 0.018 | 3.3 | 0.06 | 0.02 | 30 | 12 | 0.016 | 1.943 | 0.96 | Inventive Example |
| 4 | 0.024 | 3.3 | 0.04 | 0.02 | 40 | 14 | 0.021 | 1.945 | 0.97 | Inventive Example |
| 5 | 0.005 | 3.3 | 0.05 | 0.02 | 40 | 20 | 0.002 | 1.851 | 1.32 | Comparative Example |
| 6 | 0.035 | 3.3 | 0.04 | 0.02 | 30 | 13 | 0.033 | 1.612 | 1.74 | Comparative Example |
| 7 | commercially available general grain-oriented electrical steel sheet | | | | | | | 1.855 | 1.35 | Conventional Example |

*Al and N are expressed in ppm

As seen from Table 8, by performing the secondary recrystallization annealing in the state where C remains in amount of 0.005 to 0.025%, and after the decarburization annealing, performing an additional batch annealing at high temperature of not lower than 800° C. in a low-oxidizative or non-oxidizative atmosphere, a product sheet being superior in both magnetic flux density and iron loss in the rolling direction and not having an undercoating made of primarily forsterite ($Mg_2SiO_4$) (glass coating) can be obtained.

Example 9

Steel slabs were each processed until the decarburization annealing step under the same conditions as those in Example 7. Subsequently, the steel sheet was subjected to, while applying silica as an annealing separator, additional batch annealing in a hydrogen atmosphere (dew point: −30° C.) under conditions that temperature was elevated to 875° C. at a rate of 50° C./h and was held there for 8 hours.

Then, after applying a coating solution prepared as a mixture of aluminum phosphate and colloidal silica, flattening annealing (continuous annealing) was performed at 900° C. for 10 seconds in a hydrogen atmosphere with the dew point of −30° C. A product sheet was thus obtained.

The thus-obtained product sheet was measured for magnetic flux density ($B_8$) and iron loss ($W_{17/50}$) in the rolling direction. The results obtained are shown in Table 9.

TABLE 9

| | Material Components (mass %, ppm)* | | | | | | C Content after Primary Recrystallization Annealing | Rolling Direction of Product Sheet | | |
|---|---|---|---|---|---|---|---|---|---|---|
| No. | C | Si | Mn | Sb | Al | N | (mass %) | $B_8$ (T) | $W_{17/50}$ (W/kg) | Remarks |
| 1 | 0.007 | 3.3 | 0.04 | 0.02 | 30 | 11 | 0.006 | 1.902 | 1.22 | Inventive Example |
| 2 | 0.012 | 3.3 | 0.05 | 0.02 | 30 | 15 | 0.010 | 1.924 | 1.15 | Inventive Example |
| 3 | 0.018 | 3.3 | 0.06 | 0.02 | 30 | 12 | 0.016 | 1.922 | 1.13 | Inventive Example |
| 4 | 0.024 | 3.3 | 0.04 | 0.02 | 40 | 14 | 0.021 | 1.925 | 1.15 | Inventive Example |
| 5 | 0.005 | 3.3 | 0.05 | 0.02 | 40 | 20 | 0.002 | 1.831 | 1.39 | Comparative Example |
| 6 | 0.035 | 3.3 | 0.04 | 0.02 | 30 | 13 | 0.033 | 1.602 | 1.78 | Comparative Example |
| 7 | commercially available general grain-oriented electrical steel sheet | | | | | | | 1.855 | 1.35 | Conventional Example |

*Al and N are expressed in ppm

As seen from Table 9, by performing secondary recrystallization annealing in the state where C remains in amount of 0.005 to 0.025%, and after applying silica as the annealing separator subsequent to the decarburization annealing, performing additional batch annealing at high temperature of not lower than 800° C. in a low-oxidizative or non-oxidizative atmosphere, a product sheet being superior in both magnetic flux density and iron loss in the rolling direction and not having an undercoating made of primarily forsterite ($Mg_2SiO_4$) (glass coating) can be obtained.

Example 10

Steel slabs having material compositions shown in Table 10 were each heated to 1175° C. and then subjected to hot rolling to obtain a hot-rolled sheet with a thickness of 2.7 mm. Contents of all other components than those shown in Table 10 were each reduced to be not more than 50 ppm. The hot-rolled sheet was annealed under soaking at 850° C. for 60 seconds and then subjected to cold rolling to obtain a cold-rolled sheet with a final thickness of 0.29 mm.

Subsequently, the cold-rolled sheet was subjected to primary recrystallization annealing under soaking at 920° C. for 10 seconds in an atmosphere that contained 50 volume percent (volume %) of hydrogen and 50 volume % of nitrogen and had a dew point of −40° C. Thereafter, secondary recrystallization annealing was performed in a nitrogen atmosphere with a dew point of −40° C. without applying an annealing separator under conditions that temperature was elevated to 875° C. at a rate of 10° C./h and was held there for 50 hours.

After secondary recrystallization annealing, decarburization annealing was performed as a first-stage process at 875° C. for 60 seconds in a humid hydrogen atmosphere with a dew point of 35° C., whereby the C content was reduced to 0.0030% or below. Then, additional high-temperature continuous annealing serving also as flattening annealing was performed as a second-half process at 1020° C. for 20 seconds in a hydrogen atmosphere with a dew point of −10° C.

Subsequently, an inorganic coating solution made of primarily a phosphate was coated over the steel sheet and baked at 300° C. A product sheet was thus obtained.

The thus-obtained product sheet was measured for magnetic flux density ($B_8$) and iron loss ($W_{17/50}$) in the rolling direction. The results obtained are shown in Table 10.

TABLE 10

| No. | Material Components (mass %, ppm)* C | Si | Mn | Ni | Sn | Sb | Cu | P | Cr | Al | N | C Content after Primary Recrystallization Annealing (mass %) | Rolling Direction of Product Sheet $B_8$ (T) | $W_{17/50}$ (W/kg) | Remarks |
|---|---|---|---|---|---|---|---|---|---|---|---|---|---|---|---|
| 1 | 0.021 | 3.3 | 0.14 | tr | tr | tr | tr | tr | tr | 30 | 14 | 0.020 | 1.905 | 1.05 | Inventive Example |
| 2 | 0.022 | 3.2 | 0.13 | 0.6 | tr | 0.02 | tr | tr | tr | 55 | 20 | 0.021 | 1.923 | 1.00 | Inventive Example |
| 3 | 0.013 | 3.3 | 0.21 | tr | 0.08 | tr | tr | tr | tr | 70 | 5 | 0.011 | 1.907 | 0.98 | Inventive Example |
| 4 | 0.015 | 3.4 | 0.12 | tr | tr | 0.03 | 0.1 | tr | tr | 45 | 21 | 0.013 | 1.918 | 1.00 | Inventive Example |
| 5 | 0.012 | 3.4 | 0.10 | tr | tr | 0.03 | tr | 0.03 | tr | 20 | 20 | 0.011 | 1.903 | 1.01 | Inventive Example |
| 6 | 0.008 | 3.4 | 0.22 | tr | tr | 0.03 | tr | tr | 0.2 | 40 | 15 | 0.007 | 1.907 | 1.00 | Inventive Example |

*Al and N are expressed in ppm

As seen from Table 10, by performing secondary recrystallization annealing using a starting material, which has the composition according to the invention, in the state where C remains in amount of 0.005 to 0.025%, and performing additional continuous annealing that is united with the decarburization annealing in continuation and serves also as flattening annealing, a product sheet having a superior magnetic flux density in the rolling direction and not having an undercoating made of primarily forsterite ($Mg_2SiO_4$) (glass coating) can be obtained.

Example 11

Steel slabs having material compositions including inhibitor components, shown in Table 11, were heated to a temperature as high as 1280° C. and then subjected to hot rolling to obtain a hot-rolled sheet with a thickness of 2.2 mm. Contents of all other components than those shown in Table 11 were each reduced not to be more than 50 ppm. The hot-rolled sheet was annealed under soaking at 1050° C. for 60 seconds and then subjected to cold rolling to obtain a cold-rolled sheet with a final thickness of 0.26 mm.

Subsequently, the cold-rolled sheet was subjected to primary recrystallization annealing under soaking at 950° C. for 30 seconds in an atmosphere that contained 10 volume percent (volume %) of hydrogen and 90 volume % of nitrogen and had a dew point of −30° C.

Thereafter, secondary recrystallization annealing was performed in a nitrogen atmosphere with a dew point of −40° C. without applying an annealing separator under conditions that temperature was elevated to 1000° C. at a rate of 30° C./h and was held there for 50 hours. After the secondary recrystallization annealing, decarburization annealing was performed at 875° C. for 60 seconds in a humid hydrogen atmosphere with a dew point of 60° C., whereby the C content in the steel was reduced to 0.0030% or below.

Then, additional batch annealing was performed in a hydrogen atmosphere (dew point: −20° C.) while applying alumina as an annealing separator under conditions that temperature was elevated to 900° C. at a rate of 50° C./h and was held there for 5 hours.

After applying a coating solution prepared as a mixture of magnesium phosphate and colloidal silica, flattening annealing (continuous annealing) was performed at 850° C. for 10 seconds in a hydrogen atmosphere with a dew point of −30° C. A product sheet was thus obtained.

The thus-obtained product sheet was measured for magnetic flux density ($B_8$) and iron loss ($W_{17/50}$) in the rolling direction. The results obtained are shown in Table 11.

TABLE 11

| No. | Material Components (mass %), ppm)* C | Si | Mn | S | Se | Al | N | C Content after Primary Recrystallization Annealing (mass %) | Rolling Direction of Product Sheet $B_8$ (T) | $W_{17/50}$ (W/kg) | Remarks |
|---|---|---|---|---|---|---|---|---|---|---|---|
| 1 | 0.025 | 3.3 | 0.04 | 0.015 | tr | 20 | 21 | 0.023 | 1.895 | 0.90 | Inventive Example |
| 2 | 0.027 | 3.3 | 0.05 | 0.003 | 0.011 | 24 | 15 | 0.024 | 1.923 | 0.88 | Inventive Example |
| 3 | 0.023 | 3.3 | 0.05 | 0.002 | tr | 180 | 65 | 0.022 | 1.937 | 0.88 | Inventive Example |
| 4 | 0.025 | 3.4 | 0.05 | 0.001 | 0.013 | 210 | 60 | 0.023 | 1.938 | 0.84 | Inventive Example |

*Al and N are expressed in ppm

Example 12

Steel slabs having material compositions shown in Table 12 were manufactured by continuous casting. Contents of all other components than those shown in Table 12 were each reduced not to be more than 50 ppm. After heating each slab at 1030° C. for 20 minutes, the slab was subjected to hot rolling to obtain a hot-rolled sheet with a thickness of 2.8 mm. The hot-rolled sheet was subjected to a first step of cold rolling until the sheet thickness was reduced to 1.80 mm. After performing intermediate annealing at 900° C. for 30 seconds, the steel sheet was subjected to a second step of cold rolling to obtain a cold-rolled sheet with a final thickness of 0.30 mm.

Subsequently, the cold-rolled sheet was subjected to primary recrystallization annealing under soaking at 930° C. for 10 seconds in an atmosphere that contained 25 volume percent (volume %) of hydrogen and 75 volume % of nitrogen and had a dew point of −30° C. Thereafter, secondary recrystallization annealing (final finishing annealing) was performed in a mixed atmosphere, which contained 50 volume % of nitrogen and 50 volume % of Ar (dew point: −25° C.), while applying alumina as an annealing separator under conditions that temperature was elevated to 800° C. at a rate of 50° C./h, then elevated from 800° C. to 880° C. at a rate of 10° C./h, and was held there for 50 hours.

After secondary recrystallization annealing, flattening annealing serving also as decarburization was performed at 875° C. for 60 seconds in a humid hydrogen atmosphere with a dew point of 30° C. while applying a tension of 4 MPa to the steel sheet, whereby the C content in the steel was reduced to 0.0030% or below.

Then, a coating solution prepared as a mixture of aluminum bichromate, emulsion resin and ethylene glycol was coated over the steel sheet and baked at 300° C. A product sheet was thus obtained.

The thus-obtained product sheet was measured for magnetic flux density ($B_8$) and iron loss ($W_{17/50}$) in the rolling direction.

Further, for evaluation of punching quality, the product sheet was successively punched until the burr height reached 50 μm, by using a 50-ton press and a commercially available punching oil under conditions of a die punching diameter of 50 mmϕ (material: SKD-11), a punching rate of 350 strokes/minute, and a clearance of 6%.

The results obtained are shown in Table 12.

TABLE 12

| No. | Material Components (mass %, ppm)* C | Si | Mn | Sb | Al | N | C Content after Primary Recrystallization Annealing (mass %) | Rolling Direction of Product Sheet $B_8$ (T) | $W_{17/50}$ (W/kg) | Number of Times of Punching | Remarks |
|---|---|---|---|---|---|---|---|---|---|---|---|
| 1 | 0.010 | 2.0 | 0.10 | 0.03 | 28 | 10 | 0.008 | 1.955 | 1.35 | >3 million | Inventive Example |
| 2 | 0.005 | 2.0 | 0.10 | 0.03 | 30 | 10 | 0.003 | 1.825 | 1.75 | >3 million | Comparative Example |
| 3 | 0.010 | 5.0 | 0.10 | 0.03 | 29 | 9 | 0.008 | 1.843 | 1.01 | 2 million | Inventive Example |
| 4 | 0.005 | 5.0 | 0.10 | 0.03 | 29 | 9 | 0.003 | 1.744 | 1.55 | 2 million | Comparative Example |
| 5 | 0.010 | 3.0 | 1.5 | 0.03 | 30 | 10 | 0.008 | 1.913 | 1.20 | >3 million | Inventive Example |
| 6 | 0.005 | 3.0 | 1.5 | 0.03 | 28 | 10 | 0.003 | 1.800 | 1.40 | >3 million | Comparative Example |

*Al and N are expressed in ppm

As seen from Table 12, by performing secondary recrystallization annealing in the state where C remains in amount of 0.005 to 0.025% after primary recrystallization annealing, the product sheet having a superior magnetic flux density in the rolling direction and good punching quality can be obtained.

Thus, according to the method of the invention comprising the steps of performing primary recrystallization annealing in a non-oxidizative or low-oxidizative atmosphere after cold rolling, performing secondary recrystallization annealing in the state where C remains in an amount of about 0.005 to about 0.025%, performing the decarburization process, and preferably performing additional continuous or batch annealing at high temperature of not lower than about 800° C., a grain-oriented electrical steel sheet can be obtained which does not have an undercoating made of primarily forsterite, and which has a high magnetic flux density, a low iron loss and good punching quality.

What is claimed is:

1. A method of manufacturing a grain-oriented electrical steel sheet, comprising the steps of:

preparing a slab using molten steel containing, by mass %, C of not more than about 0.08%, Si of about 1.0 to about 8.0% and Mn of about 0.005 to about 3.0%;

rolling the slab to obtain a rolled steel sheet;

performing primary recrystallization annealing on the rolled steel sheet to form a primary recrystallized steel sheet;

performing secondary recrystallization annealing on the primary recrystallized steel sheet to form a secondary recrystallized steel sheet; and performing decarburization annealing on the secondary recrystallized steel sheet, and further comprising the step of adjusting a C content in the steel sheet before the secondary recrystallization annealing to be held in the range of about 0.005 to about 0.025 mass %, so that said secondary recrystallization annealing is performed on the steel sheet containing about 0.005 to about 0.025 mass % of C.

2. The method of according to claim 1, wherein the slab is prepared using molten steel containing C of not less than about 0.005%.

3. The method according to claim 1, wherein the C content is reduced to be less than about 50 mass ppm by the decarburization annealing.

4. The method according to claim 1, wherein molten steel containing Al and N in amounts reduced to be not more than about 150 mass ppm and about 50 mass ppm, respectively, is used as the molten steel.

5. The method according to claim 1, wherein molten steel containing Al in amount reduced to be not more than about 100 mass ppm, and N, S and Se in amounts each reduced to be not more than about 50 mass ppm is used as the molten steel.

6. The method according to claim 1, wherein the molten steel contains, by mass %, at least one component selected from the group consisting of:

| | |
|---|---|
| Ni: about 0.01 to about 1.50%, | Sn: about 0.01 to about 0.50%, |
| Sb: about 0.005 to about 0.50%, | Cu: about 0.01 to about 0.50%, |
| P: about 0.005 to about 0.50%, and | Cr: about 0.01 to about 1.50%. |

7. The method according to claim 1, wherein the rolling comprises hot rolling and cold rolling, and the rolled steel sheet is obtained by the steps of:

hot-rolling the slab to form a hot-rolled steel sheet;

optionally annealing the hot-rolled sheet; and cold rolling the hot-rolled steel sheet once, or twice or more with intermediate annealing therebetween.

8. The method according to claim 7, wherein the C content in the steel sheet before the secondary recrystallization annealing is adjusted to be held in the range of about 0.005 to about 0.025 mass % by effectuating decarburization in at least one of the annealing of the hot-rolled sheet, the intermediate annealing, and the primary recrystallization annealing.

9. The method according to claim 7, wherein the annealing of the hot-rolled sheet is performed at the temperature of about 800 to about 1000° C. so as to develop the Goss structure in the secondary crystallized steel sheet.

10. The method according to claim 7, wherein the annealing of the hot-rolled sheet is performed at the temperature of not lower than about 1000° C. so as to develop the regular cubic structure in the secondary crystallized steel sheet.

11. The method according to claim 1, wherein primary recrystallization annealing is performed in an atmosphere with a dew point of not higher than about 40° C.

12. The method according to claim 1, wherein the steel sheet has no undercoating, and secondary recrystallization annealing is performed without applying an annealing separator.

13. The method according to claim 1, wherein the steel sheet does not have an undercoating made primarily of forsterite ($Mg_2SiO_4$), and secondary recrystallization annealing is performed after applying an annealing separator not containing MgO as a main component.

14. The method according to claim 1, wherein secondary recrystallization annealing is performed in an atmosphere with a dew point of not higher than about 0° C.

15. The method according to claim 1, wherein secondary recrystallization annealing is performed in a nitrogen-containing atmosphere.

16. The method according to claim 1, wherein flattening annealing is performed after secondary recrystallization annealing.

17. The method according to claim 16, wherein flattening annealing serves also as decarburization annealing.

18. The method according to claim 1, wherein secondary recrystallization annealing is performed as batch annealing, and decarburization annealing is performed in a second half portion of the batch annealing.

19. The method according to claim 18, wherein during the decarburization annealing of said batch annealing, the C content is reduced to be less than about 50 ppm by introducing a hydrogen atmosphere with a partial pressure of not lower than about 10 volume % and by annealing at a temperature range of not lower than about 900° C.

20. The method according to claim 19, wherein in secondary recrystallization annealing, heat treatment is performed in a temperature range of about 800 to about 900° C. for about 300 minutes or longer before introducing the hydrogen atmosphere.

21. The method according to claim 1, wherein after performing decarburization annealing in a humid atmosphere subsequent to secondary recrystallization annealing, additional continuous annealing for holding the steel sheet to reside in a temperature range of not lower than about 800° C. for at least about 10 seconds is performed in an atmosphere with a dew point of not higher than about 40° C.

22. The method according to claim 21, wherein the additional continuous annealing serves also as flattening annealing.

23. The method according to claim 21, wherein the additional continuous annealing is performed substantially immediately after decarburization annealing in continuation with decarburization annealing as one uniform process.

24. The method according to claim 1, wherein after performing decarburization annealing in a humid atmosphere subsequent to secondary recrystallization annealing, additional batch annealing for holding the steel sheet to reside in the temperature range of about 800 to about 1050° C. for at least about 5 hours is performed in an atmosphere with a dew point of not higher than about 40° C.

25. The method according to claim 24, wherein the steel sheet has no undercoating, and an annealing separator is not applied before secondary recrystallization annealing and additional batch annealing.

26. The method according to claim 24, wherein the steel sheet does not have an undercoating made primarily of forsterite ($Mg_2SiO_4$), and secondary recrystallization annealing and additional batch annealing are performed without previously applying an annealing separator containing MgO as a main component.

27. The method according to claim 1, wherein the slab is prepared using molten steel containing C in an amount not more than about 0.025%.

28. A method of manufacturing a grain-oriented electrical steel sheet not having an undercoating made of primarily forsterite ($Mg_2SiO_4$) and having a high magnetic flux density, said method comprising the steps of:

hot-rolling a slab prepared using molten steel containing, by mass %, C of not more than about 0.08%, Si of about 2.0 to about 8.0% and Mn of about 0.005 to about 3.0%, in which Al and N are reduced to be not more than about 150 ppm and about 50 ppm, respectively;

cold rolling the slab once, or twice or more with intermediate annealing therebetween to form a cold-rolled steel sheet;

primary recrystallization annealing the cold-rolled steel sheet in an atmosphere with a dew point of not higher than about 40° C. and adjusting C content in a resulting primary-recrystallized steel sheet to be held in the range of about 0.005 to about 0.025 mass %;

secondary recrystallization annealing the primary-recrystallized steel sheet in an atmosphere with a dew point of not higher than about 0° C. to form a secondary recrystallized steel sheet; and flattening annealing the secondary recrystallized steel sheet such that the flattening annealing serves also as decarburization annealing.

29. A method of manufacturing a grain-oriented electrical steel sheet not having an undercoating made of primarily forsterite ($Mg_2SiO_4$) and having a high magnetic flux density and a low iron loss, said method comprising the steps of:

hot-rolling a slab prepared using molten steel containing, by mass %, C of not more than about 0.08%, Si of about 2.0 to about 8.0% and Mn of about 0.005 to about 3.0% to form a hot-rolled steel sheet;

optionally annealing the hot-rolled steel sheet;

cold rolling the hot-rolled steel sheet once, or twice or more with intermediate annealing therebetween to form a cold-rolled steel sheet;

primary recrystallization annealing the cold-rolled steel sheet in an atmosphere with a dew point of not higher than about 40° C. and adjusting a C content in a resulting primary-recrystallized steel sheet to be held in the range of about 0.005 to about 0.025 mass %;

optionally applying an annealing separator to the primary-recrystallized steel sheet; and secondary recrystallization annealing the primary-recrystallized steel sheet such that the C content is reduced to be less than about 50 ppm by introducing a hydrogen atmosphere with a partial pressure of not lower than about 10 volume % in a temperature range of not lower than about 900° C. during secondary recrystallization annealing.

30. A method of manufacturing a grain-oriented electrical steel sheet not having an undercoating made of primarily forsterite ($Mg_2SiO_4$) and having a high magnetic flux density and a low iron loss, said method comprising the steps of:

hot-rolling a slab prepared using molten steel containing, by mass %, C of not more than about 0.08%, Si of about 2.0 to about 8.0% and Mn of about 0.005 to about 3.0% to form a hot-rolled steel sheet;

optionally annealing the hot-rolled steel sheet;

cold rolling the hot-rolled steel sheet once, or twice or more with intermediate annealing therebetween to form a cold-rolled steel sheet;

primary recrystallization annealing the cold-rolled steel sheet in an atmosphere with a dew point of not higher than about 40° C. and adjusting a C content in a resulting primary-recrystallized steel sheet to be held in the range of about 0.005 to about 0.025 mass %;

secondary recrystallization annealing the primary-recrystallized steel sheet to form a secondary-recrystallized steel sheet;

decarburization annealing the secondary-recrystallized steel sheet in a humid atmosphere to form a decarburization annealed steel sheet; and performing additional continuous annealing on the decarburization annealed steel sheet by holding the steel sheet in a temperature range of not lower than about 800° C. for at least about 10 seconds in an atmosphere with a dew point of not higher than about 40° C.

31. A method of manufacturing a grain-oriented electrical steel sheet not having an undercoating made of primarily forsterite ($Mg_2SiO_4$) and having a high magnetic flux density and a low iron loss, said method comprising the steps of:

hot-rolling a slab prepared using molten steel containing, by mass %, C of not more than about 0.08%, Si of about 2.0 to about 8.0% and Mn of about 0.005 to about 3.0% to form a hot-rolled steel sheet;

optionally annealing the hot-rolled steel sheet;

cold rolling the hot-rolled steel sheet once, or twice or more with intermediate annealing therebetween to form a cold-rolled steel sheet;

primary recrystallization annealing the cold-rolled steel sheet in an atmosphere with a dew point of not higher than about 40° C. and adjusting a C content in a resulting primary-recrystallized steel sheet to be held in the range of about 0.005 to about 0.025 mass %;

secondary recrystallization annealing the primary-recrystallized steel sheet to form a secondary-recrystallized steel sheet;

decarburization annealing the secondary-recrystallized steel sheet in a humid atmosphere to form a decarburization annealed steel sheet; and performing additional batch annealing on the decarburization annealed steel sheet by holding the steel sheet in a temperature range of about 800 to about 1050° C. for at least about 5 hours in an atmosphere with a dew point of not higher than about 40° C.

* * * * *